US009343835B2

(12) United States Patent
Sasaki et al.

(10) Patent No.: US 9,343,835 B2
(45) Date of Patent: May 17, 2016

(54) TERMINAL AND CONNECTOR HAVING THE SAME

(71) Applicant: HOSIDEN CORPORATION, Yao-shi (JP)

(72) Inventors: Daisuke Sasaki, Yao (JP); Takayuki Nagata, Yao (JP); Yasuo Nakai, Yao (JP)

(73) Assignee: HOSIDEN CORPORATION, Yao-shi (JP)

( * ) Notice: Subject to any disclaimer, the term of this patent is extended or adjusted under 35 U.S.C. 154(b) by 0 days.

(21) Appl. No.: 14/456,259

(22) Filed: Aug. 11, 2014

(65) Prior Publication Data

US 2015/0056871 A1 Feb. 26, 2015

(30) Foreign Application Priority Data

Aug. 23, 2013 (JP) ..... 2013-173428

(51) Int. Cl.

| | |
|---|---|
| ***H01R 9/22*** | (2006.01) |
| ***H01R 13/04*** | (2006.01) |
| ***H01R 13/24*** | (2006.01) |
| ***H01R 13/516*** | (2006.01) |

(Continued)

(52) U.S. Cl.

CPC ..... *H01R 13/04* (2013.01); *H01R 13/2457* (2013.01); *H01R 13/516* (2013.01); *H01R 12/716* (2013.01); *H01R 13/26* (2013.01); *H01R 13/41* (2013.01)

(58) Field of Classification Search

CPC ..... H01R 13/405; H01R 13/521; H01R 9/24; H01R 43/24; B29C 45/14639

USPC ..... 439/722, 637

See application file for complete search history.

(56) References Cited

U.S. PATENT DOCUMENTS

| | | | |
|---|---|---|---|
| 3,414,871 | A | 12/1968 | Tuchel |
| 3,631,381 | A | 12/1971 | Pittman |

(Continued)

FOREIGN PATENT DOCUMENTS

| | | | |
|---|---|---|---|
| DE | 10 67 495 | B | 10/1959 |
| EP | 2 093 841 | A2 | 8/2009 |

(Continued)

OTHER PUBLICATIONS

Extended European Search Report issued on Jan. 19, 2015 fo counterpart European patent application No. 14250094.1 with English translation.

*Primary Examiner* — Abdullah Riyami
*Assistant Examiner* — Vladimir Imas
(74) *Attorney, Agent, or Firm* — Kratz, Quintos & Hanson, LLP

(57) ABSTRACT

The invention provides a terminal including a base, a first arm, a second arm, a first contact portion and a second contact portion. The base is of a plate-like shape. The first arm is of a plate-like shape and extends from the base in a first direction. The second arm is of a plate-like shape, extends from the base in the first direction, is spaced apart from the first arm in a second direction crossing the first direction, and has a larger dimension in the first direction than that of the first arm. The first contact portion is of a plate-like shape and extends from the first arm to one side of the second direction. The second contact portion is of a plate-like shape and extends from the second arm to the one side of the second direction so as to be located on one side of the first direction of the first contact portion.

3 Claims, 16 Drawing Sheets

(51) Int. Cl.

| | |
|---|---|
| *H01R 12/71* | (2011.01) |
| *H01R 13/26* | (2006.01) |
| *H01R 13/41* | (2006.01) |

(56) References Cited

U.S. PATENT DOCUMENTS

| | | | | | |
|---|---|---|---|---|---|
| 4,418,475 | A * | 12/1983 | Ammon | H01R 12/585 | 29/842 |
| 5,498,166 | A * | 3/1996 | Rothenberger | H01R 13/521 | 439/66 |
| 5,957,703 | A * | 9/1999 | Arai | H01R 12/52 | 439/591 |
| 6,062,871 | A * | 5/2000 | Arai | H01R 12/714 | 439/66 |
| 6,149,467 | A * | 11/2000 | Choy | H01R 12/721 | 439/515 |
| 6,604,950 | B2 * | 8/2003 | Maldonado | H05K 7/1069 | 439/591 |
| 6,877,992 | B2 * | 4/2005 | Grant | H01R 13/2435 | 439/591 |
| 7,037,113 | B2 * | 5/2006 | Soh | H01R 12/714 | 439/66 |
| 7,425,158 | B2 * | 9/2008 | Ookura | H01R 12/707 | 439/660 |
| 7,637,783 | B2 * | 12/2009 | Sasaoka | H01R 43/16 | 439/637 |
| 7,914,301 | B2 * | 3/2011 | Lee | H01R 13/506 | 439/329 |
| 7,997,937 | B2 * | 8/2011 | Kondo | H01R 13/6477 | 439/607.4 |
| 8,672,713 | B2 * | 3/2014 | Tajiri | H01R 12/585 | 439/630 |
| 2002/0022381 | A1 | 2/2002 | Ito et al. | | |
| 2012/0252275 | A1 | 10/2012 | Tajiri et al. | | |

FOREIGN PATENT DOCUMENTS

| | | | |
|---|---|---|---|
| JP | 2007-220511 | A1 | 8/2007 |
| JP | 2011-165682 | A | 8/2011 |

* cited by examiner

TERMINAL AND CONNECTOR HAVING THE SAME

CROSS-REFERENCE TO RELATED APPLICATIONS

The present application claims priority under 35 U.S.C. §119 of Japanese Patent Application No. 2013-173428 filed on Aug. 23, 2013, the disclosure of which is expressly incorporated by reference herein in its entity.

BACKGROUND OF THE INVENTION

1. Technical Field

The invention relates to terminals and connectors having the terminals.

2. Background Art

Japanese Patent Publication No. 2007-220511 discloses a camera module including a circuit board, a connection terminal, and a relay terminal. The relay terminal is used to connect the circuit board and the connection terminal. The relay terminal includes a base, a pair of arms, and a pair of contact portions. The base is a rectangular plate with a through-hole for receiving the connection terminal. The base is in contact with and connected to the connection terminal received in the through-hole. The arms are spaced apart from each other on the base. The arms each include first and second portions and a bent portion. The first portions of the arms are plates extending in parallel from the base. The bent portions of the arms are each provided between the first and second portions and bent Into a substantially C-like shape such that the second portions are opposed to the first portions. The second portions of the arms are plates extending obliquely upward from the bent portions. The contact portions are provided at the respective tips of the second portions of the arms. The contact portions are in contact with the same electrode on the circuit board, improving the reliability of connection between the circuit board and the connection terminal.

SUMMARY OF INVENTION

The relay terminal is manufactured by press-molding a metal plate. However, as the relay terminal is configured to include the pair of arms each having the bent portion, this configuration requires a bending process. This leads to complicated configuration of the press-molding die, resulting in increased manufacturing cost of the relay terminal.

Further, the relay terminal is configured such that the arms elastically deform to bring the contact portions closer to the first portions of the arms and thereby bring the contact portions into elastic contact with the electrode on the circuit board. However, the arms include the bent portions bent in generally C-shape such that the second portions are opposed to the first portions. The relay terminal can therefore provide a weaker contact pressure.

In light of the above circumstances, the invention provides a terminal that provides an increased contact pressure at low cost. The invention also provides a connector having the terminal.

A terminal of according to an aspect of the invention includes a base, a first arm, a second arm, a first contact portion, and a second contact portion. The base is of a plate-like shape. The first arm is of a plate-like shape and extends from the base in a first direction. The second arm is of a plate-like shape, extends from the base in the first direction, is spaced apart from the first arm in a second direction crossing the first direction, and has a larger dimension in the first direction than that of the first arm. The first contact portion is of a plate-like shape and extends from the first arm to one side of the second direction. The second contact portion is of a plate-like shape and extends from the second arm to the one side of the second direction so as to be located on one side of the first direction of the first contact portion.

Such terminal includes at least the following technical features and advantages. First, the terminal can be manufactured with a reduced cost because of the following features. In the terminal, the first and second arms are plates extending from the base in the first direction, and the first and second contact portions are plates extending from the first and second arms, respectively, in the second direction crossing the first direction. Therefore, the terminal can be easily manufactured by pressing a metal plate without any bending process. The die for producing the terminals can be simplified, resulting in reduced manufacturing costs of the terminals. Second, the first and second contact portions provide increased contact pressure against a connection object for the following reason. The first and second arms are plates extending in the first direction. They can elastically deform when the first and second contact portions contact the connection object.

A connector of the invention includes the above-described terminal and a body. The body has an insulating property and is configured to hold the terminal.

The body may include a basal portion, a tongue, a slit, and a holding hole. The tongue may extend from the basal portion in the first direction. The slit may be provided in the tongue. The holding hole may be provided in the basal portion and in communication with the slit. The base of the terminal may be held in the holding hole. The first and second arms of the terminal may be accommodated in the slit. The first and second contact portions of the terminal may include distal portions protruding from the slit.

The tongue may include a pair of tongues provided on the basal portion in spaced relation to each other along the second direction. The slit may include a plurality of slits including a first slit and a second slit. The first slit may be provided in one of the tongues, and the second slit may be provided in the other tongue. The holding hole may include a plurality of holding holes including a first holding hole and a second holding hole. The first holding hole may be provided in the basal portion and in communication with the first slit, and the second holding hole may be provided in the basal portion and in communication with the second slit. The terminal may include a plurality of terminals including a first terminal and a second terminal. The first terminal may include the base held in the first holding hole, the first and second arms accommodated in the first slit, and the distal portions of the first and second contact portions protruding from the first slit. The second terminal may include the base held in the second holding hole, the first and second arms accommodated in the second slit, and the distal portions of the first and second contact portions protruding from the second slit.

The connector according to any of the above-described aspects may further include a shell configured to cover at least an outer periphery of the body.

The shell may include a wall. The second arm may extend along the wall of the shell. In the case where the connector includes a plurality of second arms, the shell may include a plurality of walls, and the second arms may each extend along an associated one of the walls of the shell. In the connector according to these aspects, each second arm of each terminal extends along the associated wall of the shell, achieving matched impedances of each terminal.

The slit may include a plurality of slits arranged in the tongue in spaced relation to each other along a third direction, the third direction crossing the first and second directions. The holding hole may include a plurality of holding holes arranged in the basal portion in spaced relation to each other along the third direction and in communication with the respective slits. The terminal may include a plurality of terminals. The terminals may each include the base held in the associated holding hole, the first and second arms accommodated in the associated slit, and the distal portions of the first and second contact portions protruding from the associated slit. The connector may further include a shell configured to cover at least an outer periphery of the body. The shell may include a wall. The second arms of the terminals may extend along the wall of the shell. The connector according to this aspect can achieve matched impedances between the terminals.

DESCRIPTION OF EMBODIMENTS

Embodiments 1 and 2 of the invention will be described below.

Embodiment 1

Figure 1:
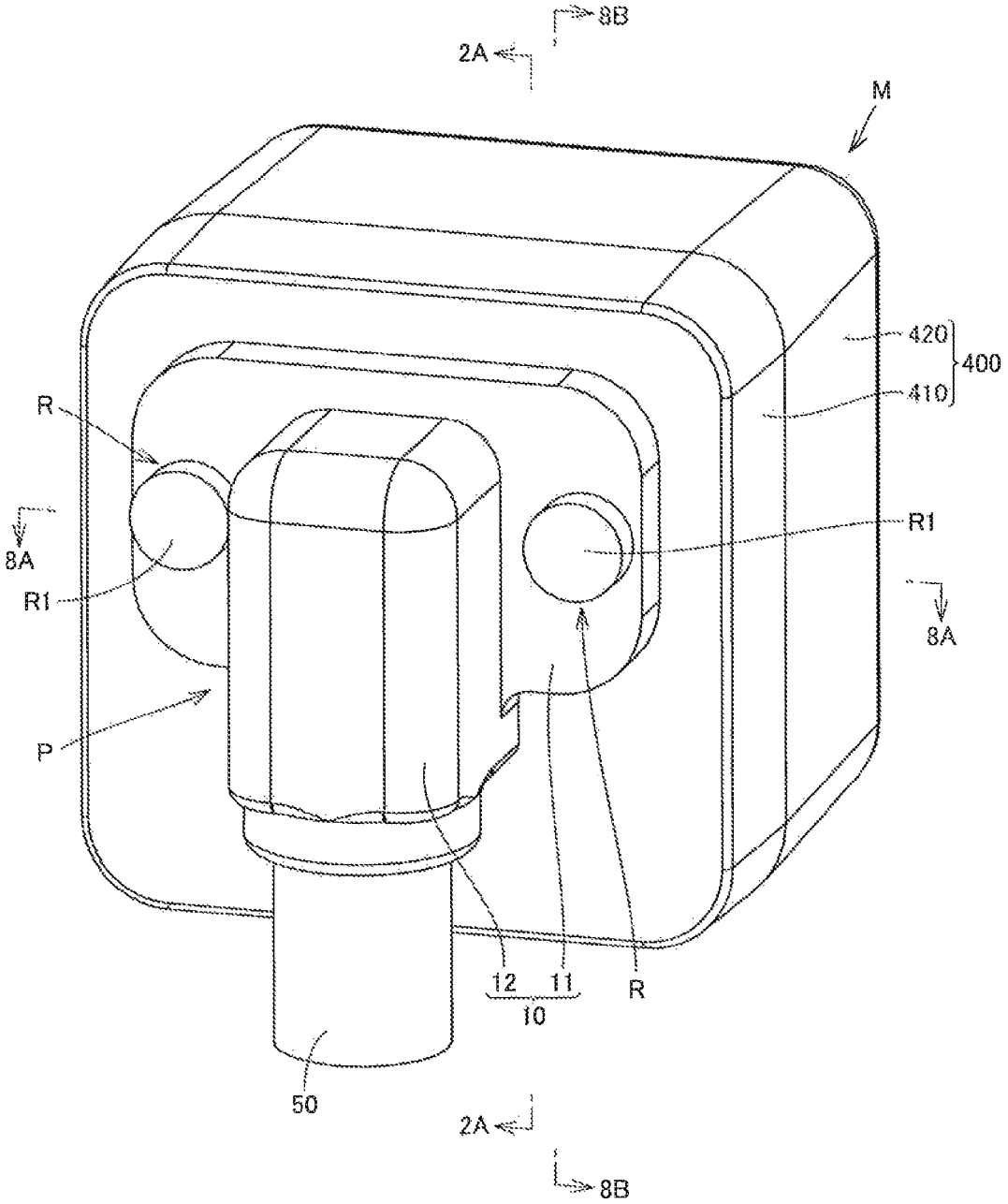
FIG. 1 is a front, top, right side perspective view of a connection structure of a module and a mating connector in accordance with Embodiment 1 of the invention.

First, a connection structure of a module and a mating connector in accordance with Embodiment 1 of the invention will be described with reference to FIG. 1 to FIG. 8B. The connection structure as shown in FIG. 1 includes a module M, a mating connector P, and a fastening mechanism R.

The module M is a component module. The module M will be described with reference to FIGS. 1 to 6. FIGS. 2A, 3, 4A, 4B, 6A, 6B, 8A, and 8B indicate a direction Z-Z', which is the insertion/removal direction of the module M and the mating connector P and corresponds to the "first direction" as defined in the claims. FIGS. 2A, 3, 4A, 6A, 6B, and 8B indicate a direction Y-Y', which is the height direction of the module M and corresponds to the "second direction" as defined in the claims. FIGS. 3, 4B, 6A, 6B, and 8A indicate a direction X-X', which is the width direction of the module M and the mating connector P and corresponds to the "third direction" as defined in the claims. The direction Y-Y' is orthogonal to the direction Z-Z'. The direction X-X' is orthogonal to the direction Y-Y' and the direction Z-Z'. The "one side in the second direction" and the "other side in the second direction" as defined in the claims may correspond to the direction Y and the direction Y', respectively. Alternatively, these two sides may correspond to the direction Y' and the direction Y, respectively.

The module M includes a connector 100, a circuit board 200, an electronic component 300, a case 400, and a packing 500.

Figure 4A:
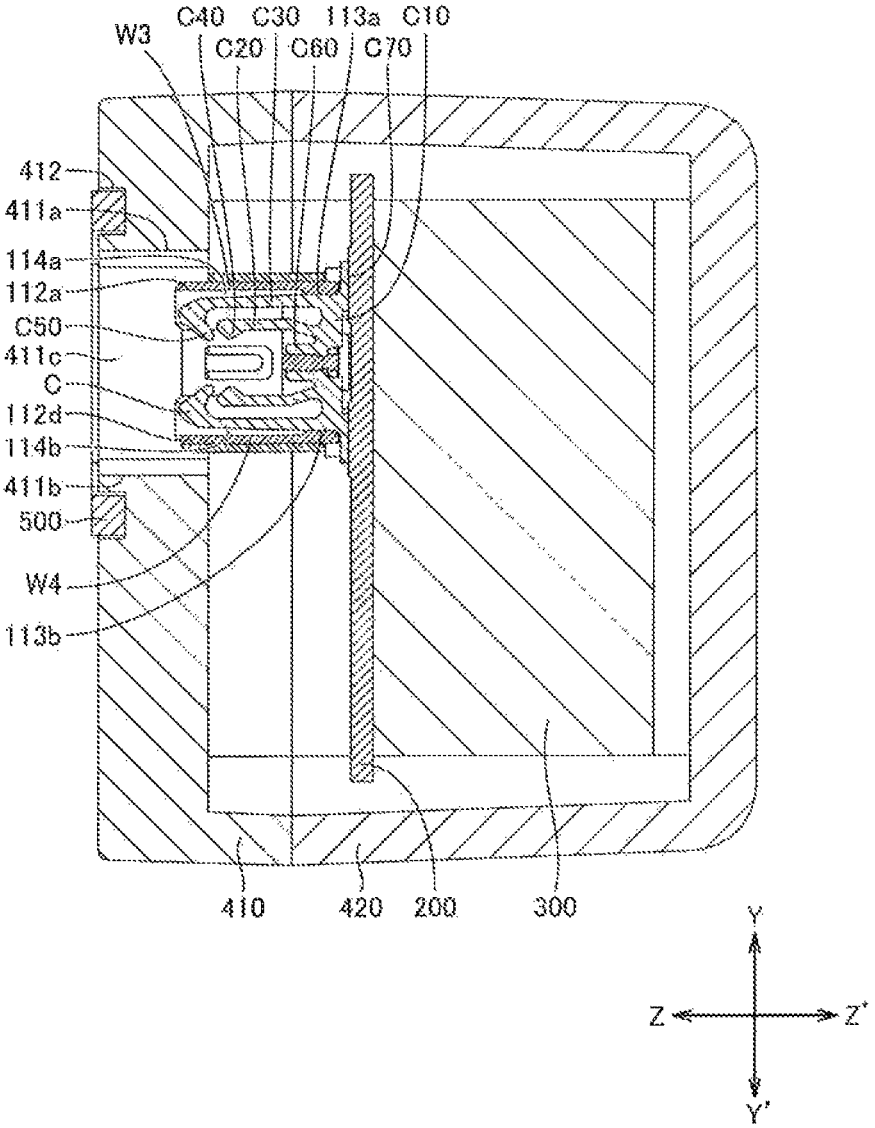
FIG. 4A is a sectional view of the module, taken along 4A-4A in FIG. 3.
Figure 4B:
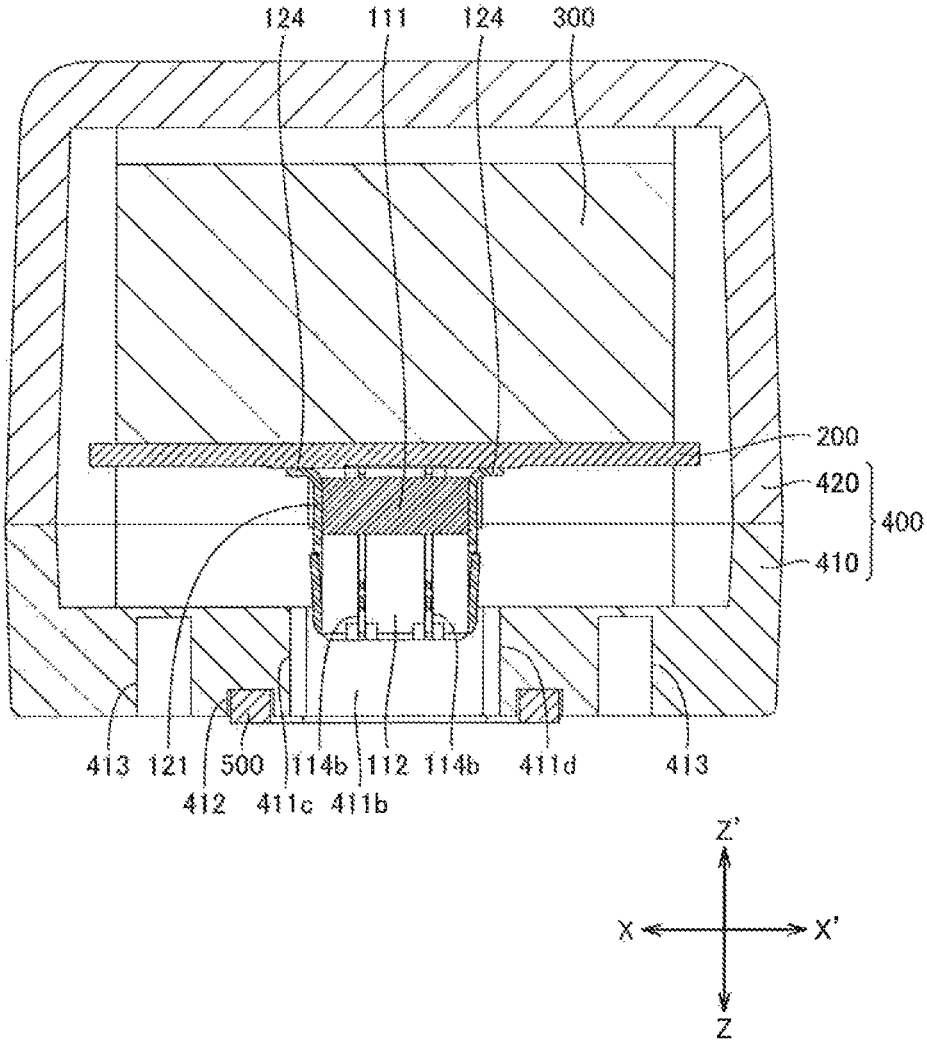
FIG. 4B is a sectional view of the module, taken along 4B-4B in FIG. 3.
Figure 5A:
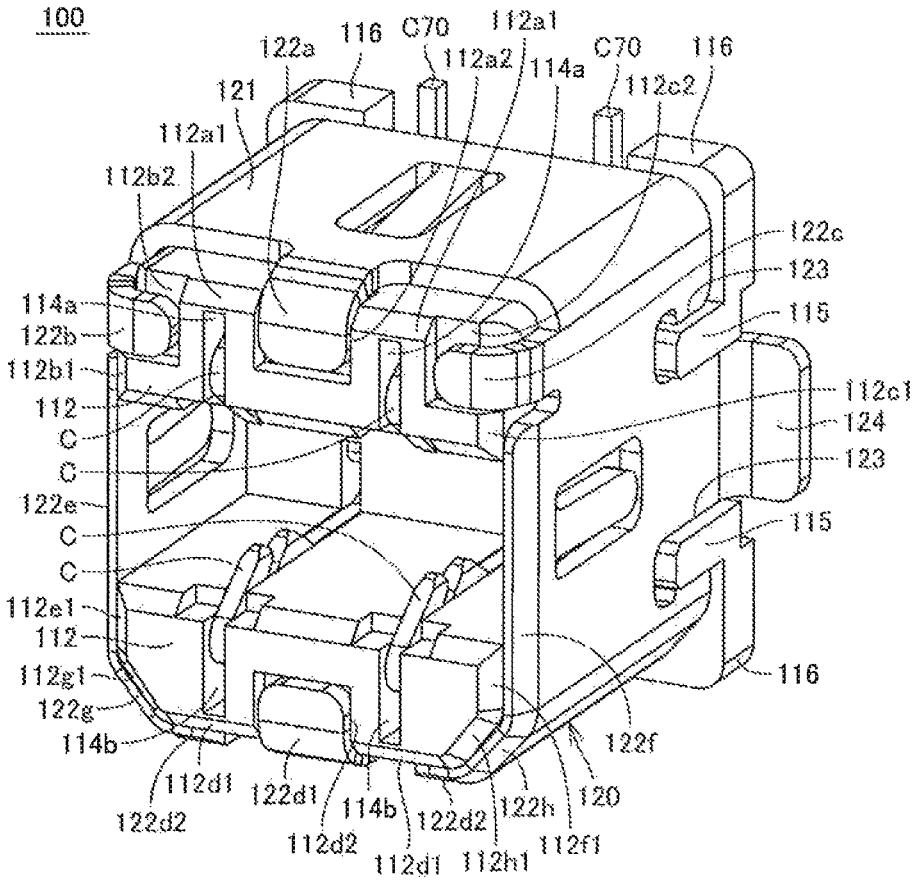
FIG. 5A is a front top, right side perspective view of a connector of the module.
Figure 5B:
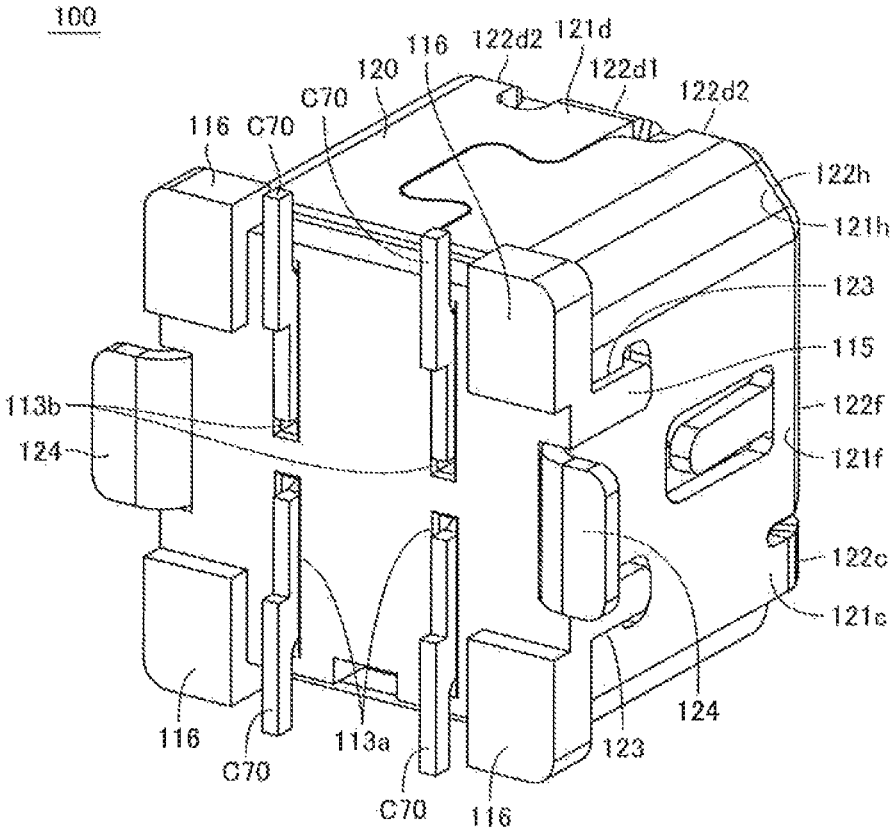
FIG. 5B is a back, bottom, right side perspective view of the connector.

As best illustrated in FIGS. 5A and 5B, the connector 100 is a hexagonal cylindrical connector that can fit into a tube 41 (to be described) of the mating connector P. As shown in FIGS. 2A to 6B, the connector 100 includes a body 110, a shell 120, and a plurality of terminals C.

Figure 6A:
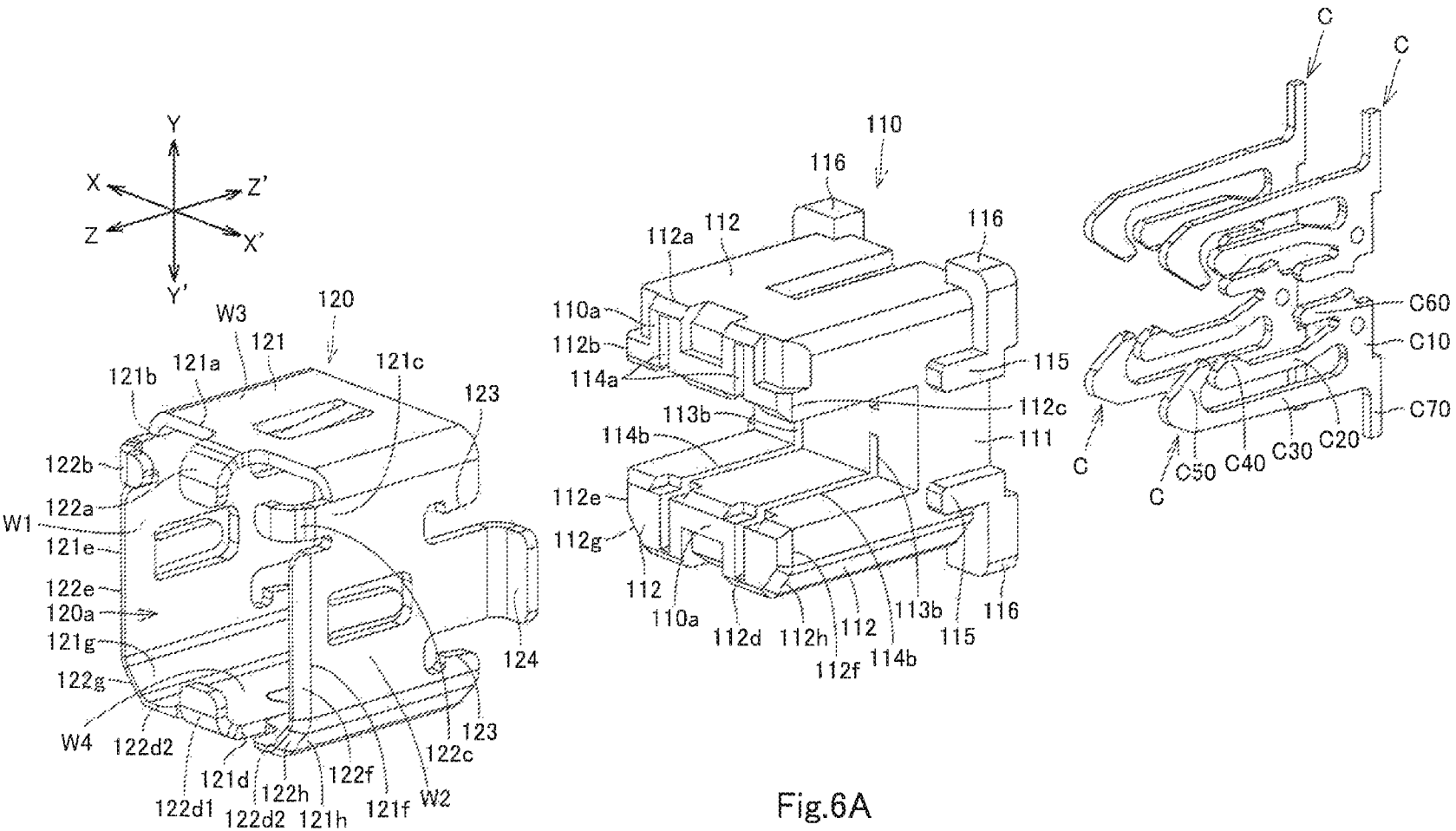
FIG. 6A is an exploded perspective view showing the front, top, right side of the connector.
Figure 6B:
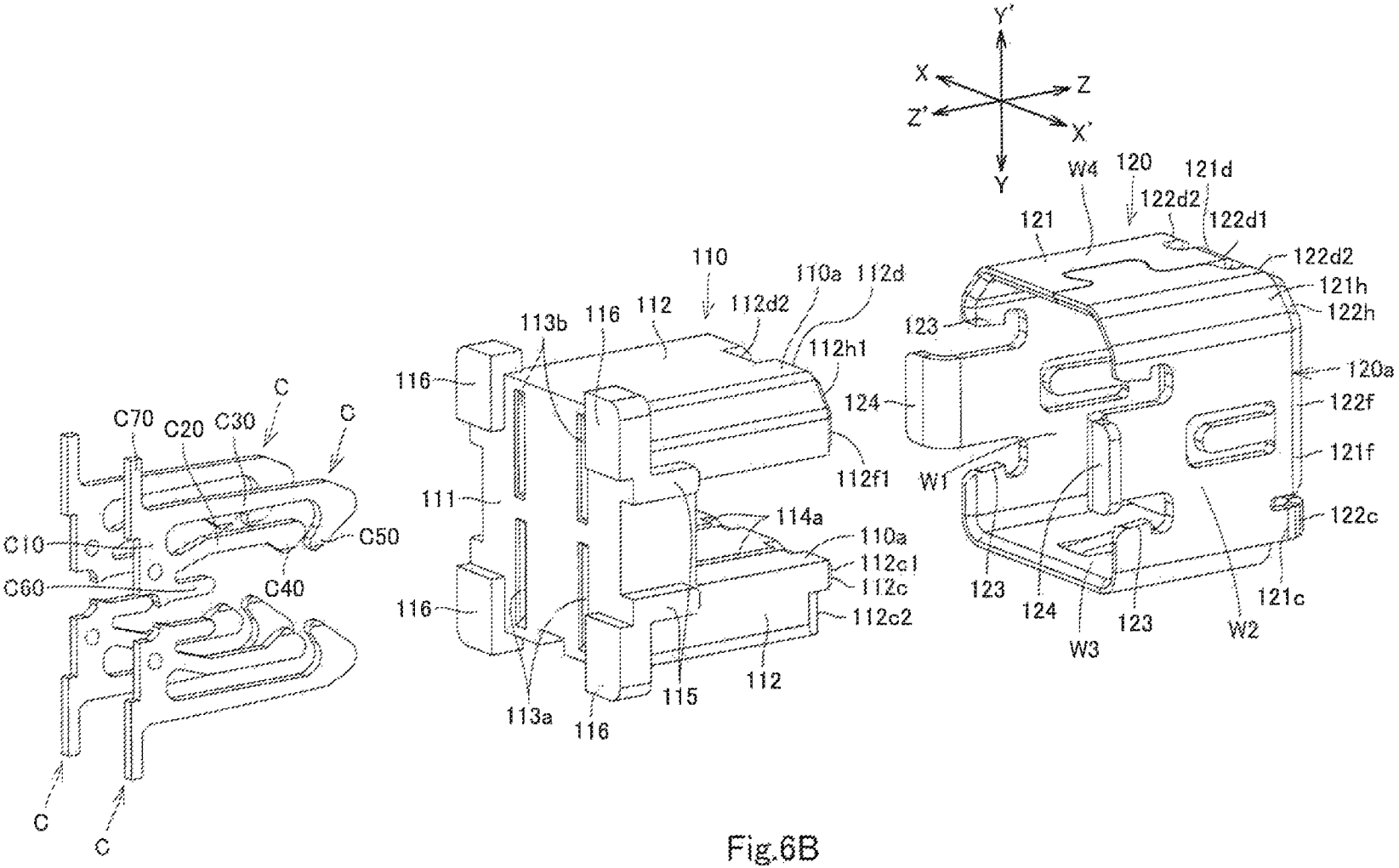
FIG. 6B is an exploded perspective view showing the back, bottom, right side of the connector.

The body 110 is made of insulating resin. As best illustrated in FIGS. 6A and 6B, the body 110 includes a basal portion 111, a pair of tongues 112, a plurality of holding holes 113*a*, 113*b*, a plurality of slits 114*a*, 114*b*, a plurality of engaging protrusions 115, and a plurality of mounts 116. The basal portion 111 is a rectangular block extending in the direction Y-Y'. The basal portion 111 includes a first end on the direction Y side and a second end on the direction Y' side.

One of the tongues 112 (upper tongue in FIG. 6A) is a rectangular plate extending from the first end of the basal portion 111 in the direction Z. The other tongue 112 (lower tongue in FIG. 6A) is a hexagonal cylindrical plate extending from the second end of the basal portion 111 in the direction Z. The upper and lower tongues 112 each include a distal portion 110*a* that is the end portion on the direction-Z-side (i.e. the distal portions 110*a* constitute the distal portion of the body 110). The distal portion 110*a* of the upper tongue 112 includes a corner 112*a*, a corner 112*b*, and a corner 112*c*. The distal portion 110*a* of the lower tongue 112 includes a corner 112*d*, a corner 112*e*, a corner 112*f*, a corner 112*g*, and a corner 112*h*.

The corner 112*a* is the corner where the distal face of the upper tongue 112 meets the direction-Y-side outer face of the distal portion 110*a* of the upper tongue 112. As best illustrated in FIG. 5A, the corner 112*a* is provided with a pair of guides 112*a*1 (third guide) spaced in the direction X-X'. The guides 112*a*1 are chamfers sloping down in a direction including components of the directions Z and Y'. A housing recess 112*a*2 is provided between the guides 112*a*1 of the distal portion 110*a* of the upper tongue 112. The corner 112*b* is the corner where the distal face of the upper tongue 112 meets the direction-X-side outer face of the distal portion 110*a* of the upper tongue 112. The corner 112*b* is provided with a guide 112*b*1 (first guide). The guide 112*b*1 is a chamfer sloping down in a direction including components of the directions Z and X'. The corner 112*c* is the corner where the distal face of the upper tongue 112 meets the direction-X'-side outer face of the distal portion 110*a* of the upper tongue 112. The corner 112*c* is provided with a guide 112*c*1 (second guide). The guide 112*c*1 is a chamfer sloping down in a direction including components of the directions Z and X. Housing recesses 112*b*2 and 112*c*2 are provided in the direction-Y-side areas of the guides 112*b*1 and 112*c*1, respectively, of the distal portion 110*a* of the upper tongue 112.

The corner 112*d* is the corner where the distal face of the lower tongue 112 meets the direction-Y'-side outer face of the distal portion 110*a* of the lower tongue 112. The corner 112*d* is provided with a pair of guides 112*d*1 (fourth guide) spaced in the direction X-X'. The guides 112*d*1 are chamfers sloping down in the direction including components of the directions Z and Y. A housing recess 112*d*2 is provided between the guides 112*d*1 of the distal portion 110*a* of the lower tongue 112. The corner 112*e* is the corner where the distal face of the lower tongue 112 meets the direction-X-side outer face of the distal portion 110*a* of the lower tongue 112. The corner 112*e* is provided with a guide 112*e*1 (first guide). The guide 112*e*1 is a chamfer sloping down in a direction including components of the directions Z and X'. The corner 112*f* is the corner where the distal face of the lower tongue 112 meets the X'-direction-side outer face of the distal portion 110*a* of the tongue 112. The corner 112*f* is provided with a guide 112*f*1 (second guide). The guide 112*f*1 is a chamfer sloping down in a direction including components of the directions Z and X. The corner 112*g* is the corner where the distal face of the lower tongue 112 meets the direction-X-and-Y'-side outer face of the distal portion 110*a* of the lower tongue 112. The corner 112*g* is provided with a guide 112*g*1. The guide 112*g*1 is a chamfer sloping down in a direction including components of the directions Z, Y, and X'. The corner 112*h* is the corner where the distal face of the lower tongue 112 meets the direction-X'-and-Y-side outer face of the distal portion 110*a* of the tongue 112. The corner 112*h* is provided with a guide 112*h*1. The guide 112*h*1 is a chamfer sloping down in a direction including components of the directions Z, Y, and X.

As best illustrated in FIGS. 6A and 6B, the slits 114*a* ("first slit" as defined in the claims) are arranged in the upper tongue 112 in spaced relation to each other along the direction X-X'. The slits 114*a* are open to the direction Y' side. The slits 114*b* ("second slit" as defined in the claims) are arranged in the lower tongue 112 in spaced relation to each other along the direction X-X'. The slits 114*b* are open to the direction Y' side. The slits 114*b* are symmetrically shaped with respect to the slits 114*a*. The holding holes 113*a* ("first holding hole" as defined in the claims) are provided in the basal portion 111, in communication with the respective slits 114*a*. The holding holes 113*a* are open to the direction Z'. The holding holes 113*b* ("second holding hole" as defined in the claims) are provided in the basal portion 111, in communication with the respective slits 114*b*. The holding holes 113*b* are symmetrically shaped with respect to the holding holes 113*a* and are open to the direction Z'.

As best illustrated in FIGS. 6A and 6B, the mounts 116 are rectangular blocks provided at the respective four corners of the direction Z' end face of the basal portion 111. Two of the engaging protrusions 115, located on the direction X side, are rectangular protrusions on the direction-X-side end face of the basal portion 111, arranged in spaced relation to each other along the direction Y-Y' to extend in the direction Z-Z'. The other two engaging protrusions 115, located on the direction X' side, are rectangular protrusions on the direction-X'-side end face of the basal portion 111, arranged in spaced relation to each other along the direction Y-Y' to extend in the direction Z-Z' from.

As shown in FIGS. 6A and 6B, the terminals C are metal plates. The terminals C each have a base C10, first and second arms C20, C30, first and second contact portions C40, C50, engaging portion C60, and a tail C70. The base C10 is a plate (part of the metal plate) extending in the direction Y-Y'. The first and second arms C20, C30 are plates (part of the metal plate) in spaced relation to each other along the direction Y-Y', extending from the base C10 in the direction Z. The second arm C30 has a larger dimension in the direction Z-Z' than that of the first arm C20. The first and second arms C20, C30 are elastically deformable in their alignment direction (i.e. the direction Y-Y').

The first contact portion C40 is a plate (part of the metal plate) extending from the direction Z end (distal end) of the first arm C20 to one side in the alignment direction (in the direction Y or Y'). In Embodiment 1, the first contact portion C40 extends to one side of the alignment direction (the direction Y or the direction Y'). The second contact portion C50 is a plate extending from the direction-Z end of the second arm C30 to the one side in the alignment direction. The second contact portion C50 is located on the direction-Z side of the first contact portion C40. In Embodiment 1, the second contact portion C50 extends in a direction including components of the one side of the alignment direction and the direction Z'. The distal end on the one side of the alignment direction of the second contact portion C50 is located at substantially the same height in the alignment direction as, or alternatively slightly further in the alignment direction than, the distal end on the one side of the alignment direction of the first contact portion C40.

The engaging portion C60 is a plate (part of the metal plate) extending in the direction Z from the base C10, more particularly from its end on the one side of the alignment direction. The engaging portion C60 includes a protrusion protruding to the one side of the alignment direction. The tail C70 is a plate (part of the metal plate) extending to the other side in the alignment direction from the base C10, more particularly from its end on other side in the alignment direction.

Each terminal C is configured such that the direction Y-Y' dimension from the protrusion of the engaging portion C60 to the end on the other side of the alignment direction of the base C10 is slightly larger than the direction Y-Y' dimension of the associated holding hole 113*a* or 113*b*. As to two of the terminals C (i.e. upper terminals C as shown in FIG. 4A, the first terminal as defined in the claims), each terminal C is configured such that the base C10 and the engaging portion C60 are press-fitted and held in the associated holding hole 113*a*, that the first and second arms C20, C30 are accommodated in the associated slit 114*a*, that the distal portions of the first and second contact portions C40, C50 protrude from the associated slit 114*a* to the direction Y' side (downward in FIG. 4A), and that the tail C70 is in contact with the direction-Z'-side end face of the body 110. As to the two remaining terminals C (i.e. lower terminals C as shown in FIG. 4A, the second terminal as defined in the claims), each terminal C is configured such that the base C10 and the engaging portion C60 are press-fitted and held in the associated holding hole 113*b*, that the first and second arms C20, C30 are accommodated in the associated slit 114*b*, that the distal portions of the first and second contact portions C40, C50 protrude from the associated slit 114*b* to the direction Y side (upward in FIG. 4A), and that the tail C70 is in contact with the direction-Z'-side end face of the body 110. The first and second contact portions C40, C50 of the upper terminals C are opposed to the first and second contact portions C40, C50 of the lower terminals C. All the terminals C are arranged such that the end faces on the direction Z' side of the tails C70 are located substantially at the same height in the direction Z-Z as the end faces on the direction Z side of the mounts 116 of the body 110'. That is, the tails C70 and the mounts 116 are disposed on the same face of the circuit board 200. The tails C70 are connected to the circuit board 200.

As best illustrated in FIG. 6A and FIG. 6B, the shell 120 is a hexagonal tube formed of a metal plate. The shell 120 includes a shell body 121, guides 122*a* to 122*h*, a plurality of engaging recesses 123, and a pair of legs 124. The shell body 121 is a hexagonal tube. The inner shape of the shell body 121 conforms to the outer shape of the body 110. The body 110 fits in the shell body 121. In other words, the shell body 121 covers the outer periphery of the body 110. The shell body 121 includes a direction-X-side wall W1, a direction-X'-side wall W2, a direction-Y-side wall W3, and a direction-Y'-side wall W4. The direction-X-side wall W1 of the shell body 121, the direction-X'-side wall W2 of the shell body 121, and the tongues 112 of the body 110 define a connection hole of the connector 300. The outer shape of the shell body 121 conforms to the inner shape of the tube 41 (to be described) of the mating connector P. The shell body 123 can fit in the tube 41. As shown in FIG. 4A, the direction-Y-side wall W3 of the shell body 121 extends substantially parallel to the second arms C30 of the upper terminals C. The direction-Y'-side wall W4 of the shell body 121 extends substantially parallel to the second arms C30 of the lower terminals C. In other words, the second arms C30 of the terminals C extend along the direction-Y-side wall W3 or the direction-Y'-side wall W4 to allow for impedance matching of each of the terminals C. This results in matched impedance between the upper terminals C and between the lower terminals C.

The shell body 121 further includes a lip 120*a* on the direction Z side and a lip on the direction Z' side. The direction-Z-side lip 120*a* includes a first portion of generally inverted U-shape, and a second portion that is the remaining portion of generally U-shape. The distal face of the first portion is located further to the direction Z' side (lower side) than the distal face of the second portion, and further to the direction Z' side (lower side) than the direction-Z'-side ends (lower ends) of the guides 112*a*1 of the body 110. The distal face of the second portion is located at substantially the same height in the direction Z-Z' as the direction-Z'-side ends (lower ends) of the guides 112*b*1, 112*c*1, 112*d*1, 112*e*1, 112*f*1, 112*g*1, and the 112*h*1 of the body 110. The first portion includes corners 121*a*, 121*b*, and 121*c*. The second portion includes corners 121*d*, 121*e*, 121*f*, 121*g*, and 121*h*.

The corner 121*a* is the corner where the distal face of the first portion of the lip 120*a* meets the direction-Y-side outer face of the first portion. As best illustrated in FIG. 6A, the corner 121*a* includes a guide 122*a* (third guide), which is a curved portion that extends in the direction Z and then curves in the direction Y' (inwards of the connector 100). The distal portion of the guide 122*a* is housed in a housing recess 112*a*2 in the upper tongue 112 of the body 110 (see FIG. 5A). The corner 121*b* is the corner where the distal face of the first portion of the lip 120*a* meets the direction-X-side outer face of the first portion. The corner 121*b* includes a guide 122*b* (first guide), which is a curved portion that extends in the direction Z and then curves in the direction X' (inwards of the connector 100). The distal portion of the guide 122*b* is housed in a housing recess 112*b*2 in the upper tongue 112 of the body 110 (see FIG. 5A). The corner 121*c* is the corner where the distal face of the first portion of the lip 120*a* meets the direction-X'-side outer face of the first portion. The corner 121*c* includes a guide 122*c* (second guide), which is a curved portion that extends in the direction Z and then curves in the direction X (inwards of the connector 100). The distal portion of the guide 122*c* is housed in a housing recess 112*c*2 in the upper tongue 112 of the body 110 (see FIG. 5A).

The corner 121*d* is the corner where the distal face of the second portion of the lip 120*a* and the direction-Y'-side outer face of the second portion. The corner 121*d* is centrally provided with a guide 122*d*1 (fourth guide). The corner 121*d* further includes a pair of guides 122*d*2 (fourth guide), one at either end of the guide 122*d*1. The guide 122*d*1 is a curved portion that extends in the direction Z and then curves in the direction Y (inwards of the connector 100). The distal portion of the guide 122*d*1 is housed in the housing recess 112*d*2 in the lower tongue 112 of the body 110 (see FIG. 5A). The guides 122*d*2 are chamfers sloping down in a direction including components of the directions Z and Y. The guides 122*d*2 are located on the direction Z' side of the guides 112*d*1 of the body 110. The corner 121*e* is the corner where the distal face of the second portion of the lip 120*a* meets the direction-X-side outer face of the second portion. The corner 121*e* includes a guide 122*e* (first guide), which is a chamfer sloping down in a direction including components of the directions Z and X'. The guide 122*c* is located on the direction Z' side of the guides 112*b*1, 112*e*1 of the body 110. The corner 121*f* is the corner where the distal face of the second portion of the lip 120*a* and the direction-X'-side outer face of the second portion. The corner 121*f* includes a guide 122*f* (second guide), which is a chamfer sloping down in a direction including components of the directions Z and X. The guide 122*f* is located on the direction Z' side of the guide 112*c*1, 112*f*1 of the body 110. The corner 121*g* is the corner where the distal face of the second portion of the lip 120*a* meets the outer face on the directions X and Y' side of the second portion. The corner 121*g* includes a guide 122*g*, which is a chamfer sloping down in a direction including components of the directions Z, Y, and X'. The guide 122*g* is located on the direction Z' side of the guide 112*g*1 of the body 110. The corner 121*h* is the corner where the distal face of the second portion of the lip 120*a* meets the outer face on the X' and Y' direction side of the second portion. The corner 121*h* includes a guide 122*b*, which is a chamfer sloping down in a direction including components of the directions Z, Y, and X. The guide 122*h* is located on the direction Z' side of the guide 112*h*1 of the body 110.

Of the engaging recesses 123, the two ones on the direction X side are recesses in the direction-X-side wall W1 of the shell body 121, extending in the direction Z-Z' at spaced relation to each other along the direction Y-Y'. These engaging recesses 123 fit over the respective engaging protrusions 115 on the direction X side. The two engaging recesses 123 on the direction X' side are recesses in the direction-X'-side wall W2 of the shell body 121, extending in the direction Z-Z' at spaced relation to each other along the direction Y-Y'. These engaging recesses 123 fit over the respective engaging protrusions 115 on the direction X' side.

Of the legs 124, the one on the direction X side is provided between the engaging recesses 123 in the direction-X-side wall W1 of the shell body 121 and bent at substantially right angles to the shell body 121. The leg 124 on the direction X' side is provided between the engaging recesses 123 in the direction-X'-side wall W2 of the shell body 121 and bent at substantially right angles to the shell body 121. Both legs 124 are electrically connected to the circuit board 200.

The circuit board 200 is a printed circuit board as best illustrated in FIGS. 4A and 4B. The circuit board 200 includes first and second faces opposite to each other. The connector 100 is mounted on the first face of the circuit board 200. The electronic component 300 is mounted on the second face of the circuit board 200.

The electronic component 300 is an electronic component for automobile, mounted on the first face of the circuit board 200. For example, the electronic component 300 may be a camera unit used to take images of the rear and/or surrounding views of an automobile.

Figure 3:
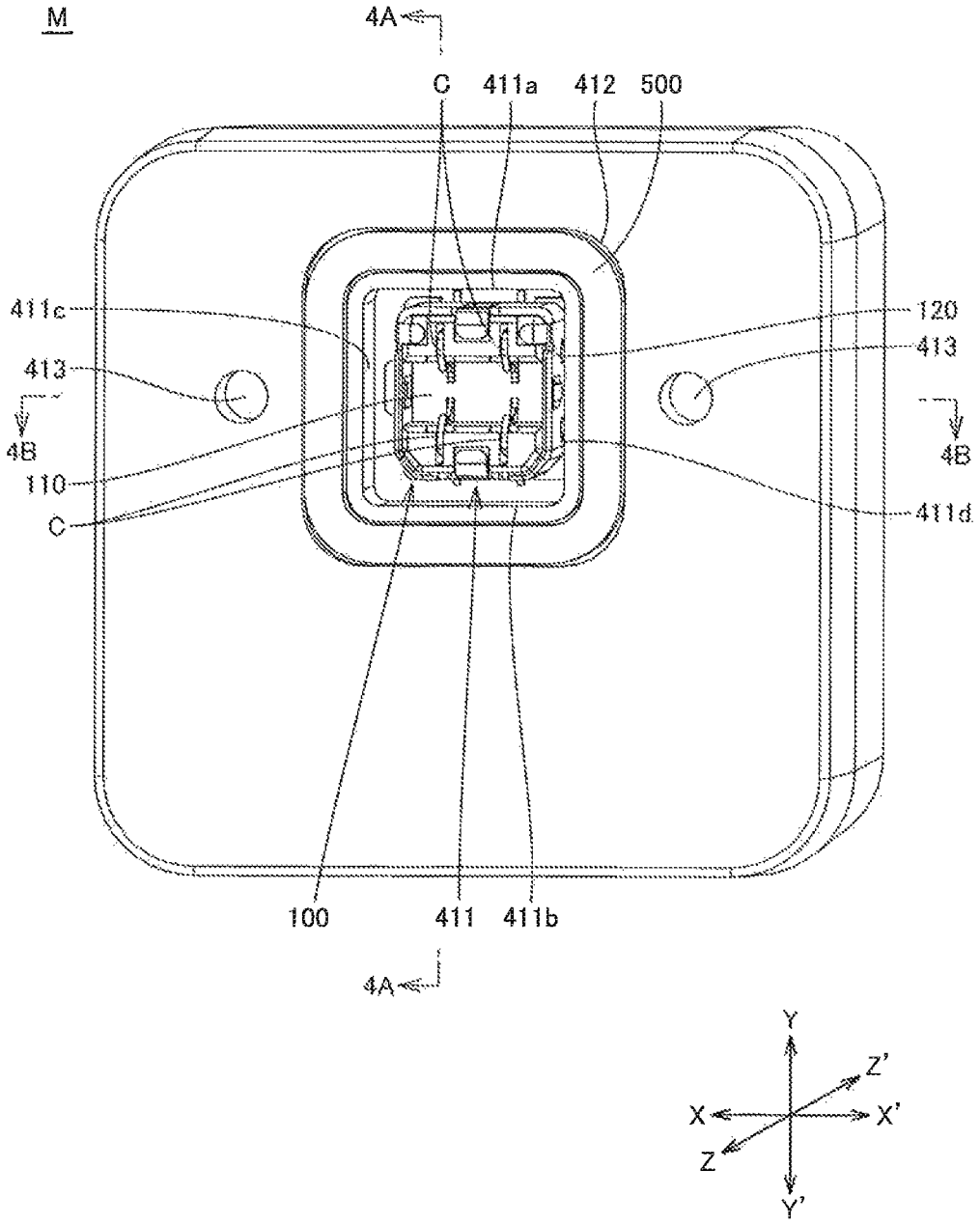
FIG. 3 is a front, top, right side perspective view of the module of the connection structure.

As best illustrated in FIGS. 3 to 4B, the case 400 includes a first case 410 and a second case 420. The first case 410 is a generally rectangular box. The first case 410 includes a bottom and a peripheral wall standing on and along the periphery of the bottom. The bottom of the first case 410 is provided therethrough with a rectangular through-hole 411. The through-hole 411 has larger dimensions than the outer dimensions of the connector 100 and than the outer dimensions of the tube 41 (to be described) of the mating connector P. The through-hole 411 includes inner walls 411*a*, 411*b* (third and fourth inner walls) opposed to each other in the direction Y-Y' and inner walls 411*c*, 411*d* (first and second inner walls) opposed to each other in the direction X-X'. The inner wall 411*a* is adjacent and spaced apart from the guides 112*a*1 of the body 110 and the guide 122*a* of the shell 120 of the connector 100. The inner wall 411*b* is adjacent and spaced apart from the guides 112*d*1 of the body 110 and the guides 122*d*1, 122*d*2 of the shell 120 of the connector 100. The inner wall 411*c* adjacent and spaced apart from the guides 112*b* 1, 112*e*1 of the body 110 and the guides 122*b*, 122*c* of the shell 120 of the connector 100. The inner wall 411*d* is adjacent and spaced apart from the guide 112*c*1, 112*f*1 of the body 110 and the guides 122*c*, 122*f* of the shell 120 of the connector 100.

Figure 8A:
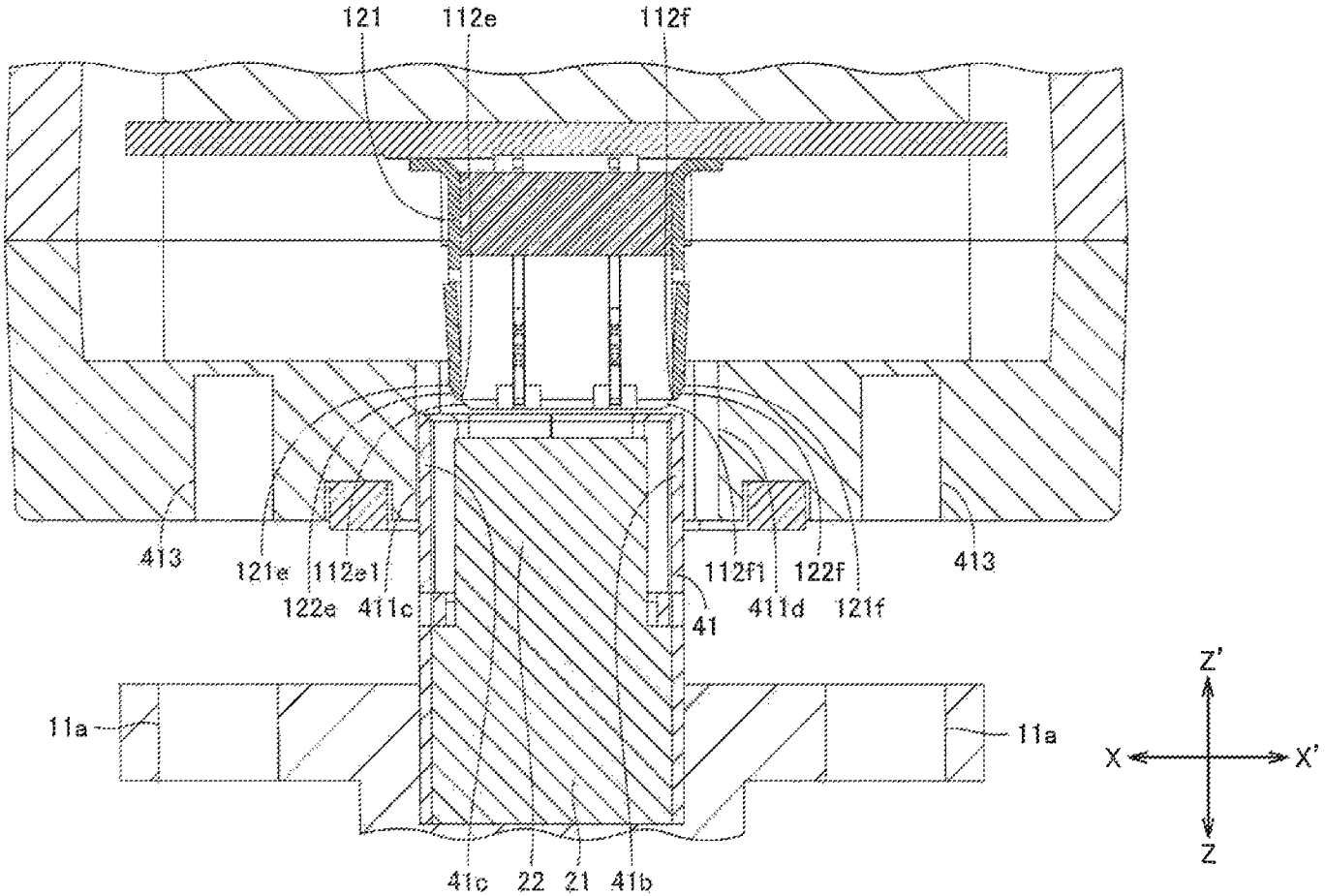
FIG. 8A is a sectional view illustrating a connection process of the module and the mating connector in the connection structure, taken along 8A-8A in FIG. 1.
Figure 8B:
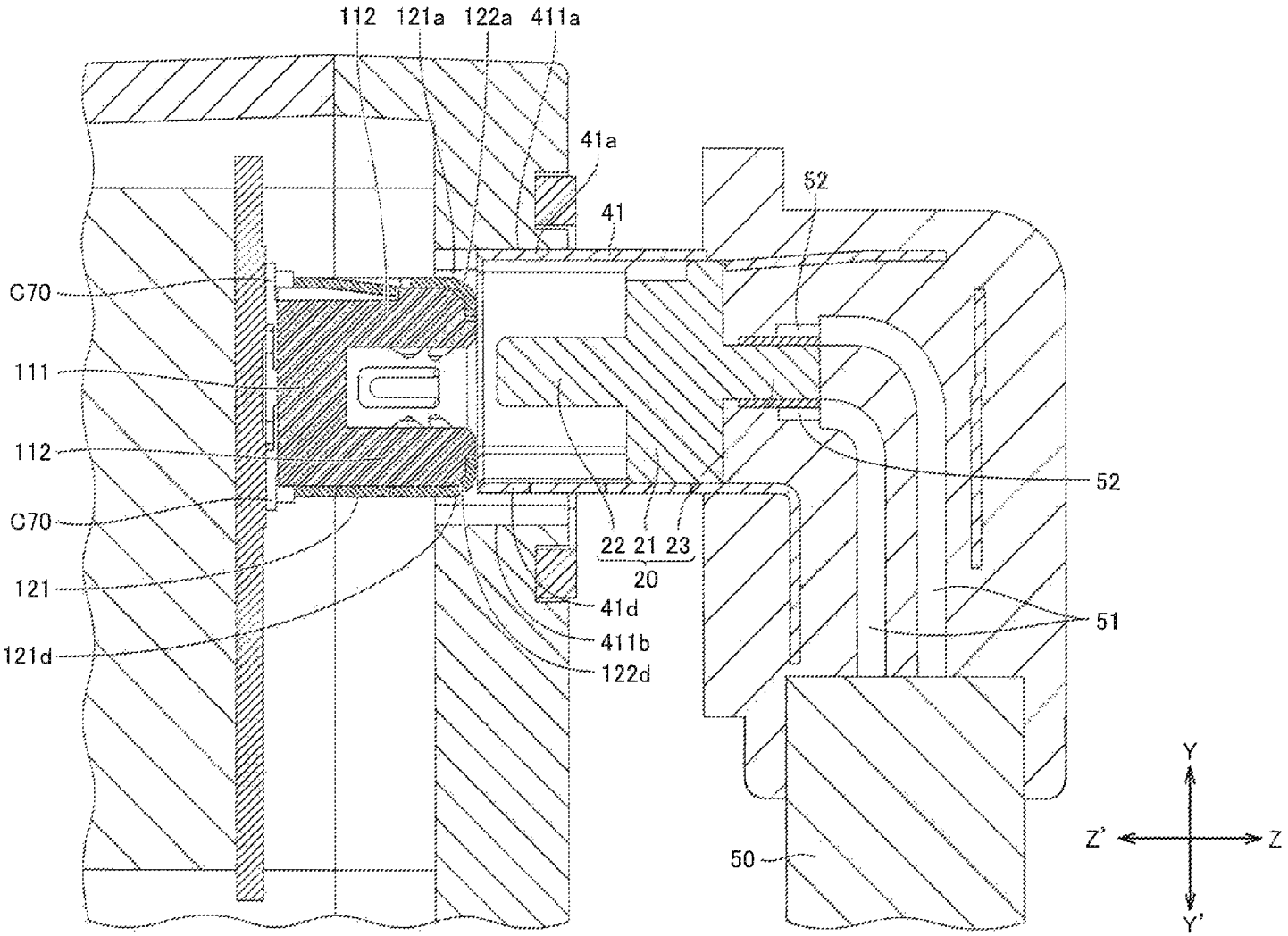
FIG. 8B is a sectional view illustrating a connection process of the module and the mating connector in the connection structure, taken along 8B-8B in FIG. 1.

In the module M, the relative positioning of the first inner wall (inner wall 411*c*) with respect to the second guide (the guides 112*c*1, 112*f*1 of the body 110 and the guides 122*c*, 122*f* of the shell 120) is such that, as shown in FIG. 8A, when the tube 41 (to be described) abuts the first inner wall at its wall 41*c* (a portion on the side of the first inner wall), its wall 41*b* (a portion on the side of the second inner wall) can be located on the second guide. Also in the module M, the relative positioning of the second inner wall (inner wall 411*d*) with respect to the first guide (the guides 112*b*1, 112*e*1 of the body 110 and the guides 122*b*, 122*e* of the shell 120) is such that when the tube 41 abuts the second inner wall at its wall 41*b* (the portion on the side of the second inner wall), its wall 41*c* (the portion on the side of the first inner wall) can be located on the first guide. Also in the module M, the relative positioning of the third inner wall (inner wall 411*a*) and the fourth guide (the guides 112*d*1 of the body 110 and the guides 122*d*1, 122*d*2 of the shell 120) is such that, as shown in FIG. 8B, when the tube 41 abuts the third inner wall at its wall 41*a* (a portion on the side of the third inner wall), its wall 41*d* (a portion on the side of the fourth inner wall) can be located on the fourth guide. Also in the module M, the relative positioning of the fourth inner wall (inner wall 411*b*) and the third guide (the guides 112*a*1 of the body 110 and the guide 122*a* of the shell 120) is such that when the tube 41 abuts the fourth inner wall at its wall 41*d* (the portion on the side of the fourth inner wall), its wall 41*a* (the portion on the side of the third inner wall) of the tube 41 can be located on the third guide.

As best illustrated in FIG. 3, a ring-shaped recess 412 is provided around the through-hole 411 in the bottom of the first case 410. In other words, the through-hole 411 is provided inside the recess 412. The recess 412 is adapted to receive a ring-shaped packing 500. The thickness of the packing 500 is larger than the depth of the recess 412, so that the packing 500 protrudes at its direction-Z end from the recess 412. A pair of cylindrical engaging holes 413 (first engaging holes) are formed on the direction X side and on the direction X' side in the recess 412 of the bottom of the first case 410.

The second case 420 is a generally rectangular box to be combined with the first case 410 in the direction Z-Z'. The second case 420 includes a bottom and a peripheral wall standing on and along the periphery of the bottom. The peripheral wall of the second case 420 is welded to the peripheral wall of the first case 410. The combined first and second cases 410, 420 provide inner space to house the connector 100, the circuit board 200, and the electronic component 300. The circuit board 200 is affixed to at least one of the first and second cases 410, 420 such that the distal portions of the tongues 112 of the body 110 of the connector 100 and the second portion of the direction-Z-side lip 120*a* of the shell 120 are located inside the through-hole 411 of the first case 410. The circuit board 200 will be hereinafter described as fixed to the second case 420.

The module M as described above may be assembled in the following steps. For convenience of description, the electronic component 300 will be described as a camera module. First, the connector 100 may be assembled as follows. The body 110 and the plurality of terminals C are prepared. Two of the terminals C are pressed into the respective holding holes 113*a* of the body 110. The bases C10 and the engaging portions C60 of the terminals C are thus held in the respective holding holes 113*a*. Also, the first and second contact portions C40, C50 of the terminals C are received in the respective slits 114*a*, and the distal portions of the first and second contact portions C40, C50 protrude from the respective slits 114*a*. That is, the distal portions of the first and second contact portions C40, C50 are located in the connection hole of the connector 100. The first and second arms C20, C30 of the terminals C are housed in the respective slits 114*a*. Similarly, the remaining terminals C are inserted into the holding holes 113*b* and the slits 114*b* of the body 110 to be attached to the body 110. Next, the shell 120 is prepared and fitted over the body 110. Then, the guides 122*a*, 122*b*, and 122*c* are accommodated in the housing recesses 112*a*2, 112*b*2, and 112*e*2 of the body 110, respectively. The second arms C30 of the terminals C are disposed along the direction-Y-side wall W3 or the direction-Y'-side wall W4 of the shell 120.

Next, this assembled connector 100, the circuit board 200, and the electronic component 300 are prepared. The electronic component 300 is mounted on the second face of the circuit board 200, and the connector 100 is mounted on the first face of the circuit board 200. The tails C70 of the terminals C of the connector 100 are connected to associated electrodes on the first face of the circuit board 200, and the legs 124 of the shell 120 are soldered to ground electrodes on the first face of the circuit board 200.

The second case 420 is also prepared. Accommodated into the second case 420 are the circuit board 200, the electronic component 300, and the connector 300, with the second face of the circuit board 200 facing the bottom of the second case 420. The circuit board 200 is affixed to the second case 420 such that the center of an imaging device (for example, CCD, CMOS or the like) of the electronic component 300 is aligned with the optical axis of a lens (not shown) provided in the second case 420. The first case 410 is also prepared and combined with the second case 420. Specifically, the peripheral wall of the first case 410 is confronted with the peripheral wall of the second case 420. Upon combining the first and second cases 410, 420, the distal portion (the distal portions 110*a* of the tongues 112 of the body 110 and the second portion of the direction-Z-side lip 120*a* of the shell 120 collectively) of the connector 100 is disposed into the through-hole 411 of the first case 410. Then, the guides 112*a*1 of the body 110 of the connector 100 and the guide 122*a* of the shell 120 are disposed on the side of the inner wall 411*a* in the through-hole 411; the guides 112*d*1 of the body 110 of the connector 100 and the guides 122*d*1, 122*d*2 of the shell 120 are disposed on the side of the inner wall 411*b* in the through-hole 411; the guides 112*b*1, 112*e*1 of the body 110 of the connector 100 and the guides 122*b*, 122*e* of the shell 120 are disposed on the side of the inner wall 411*c* in the through-hole 411; and the guides 112*c*1, 112*f*1 of the body 110 of the connector 100 and the guides 122*c*, 122*f* of the shell 120 are disposed on the side of the inner wall 411*d* in the through-hole 411. Finally, the peripheral wall of the first case 410 is welded to the peripheral wall of the second case 420. The module M is now assembled.

Figure 7A:
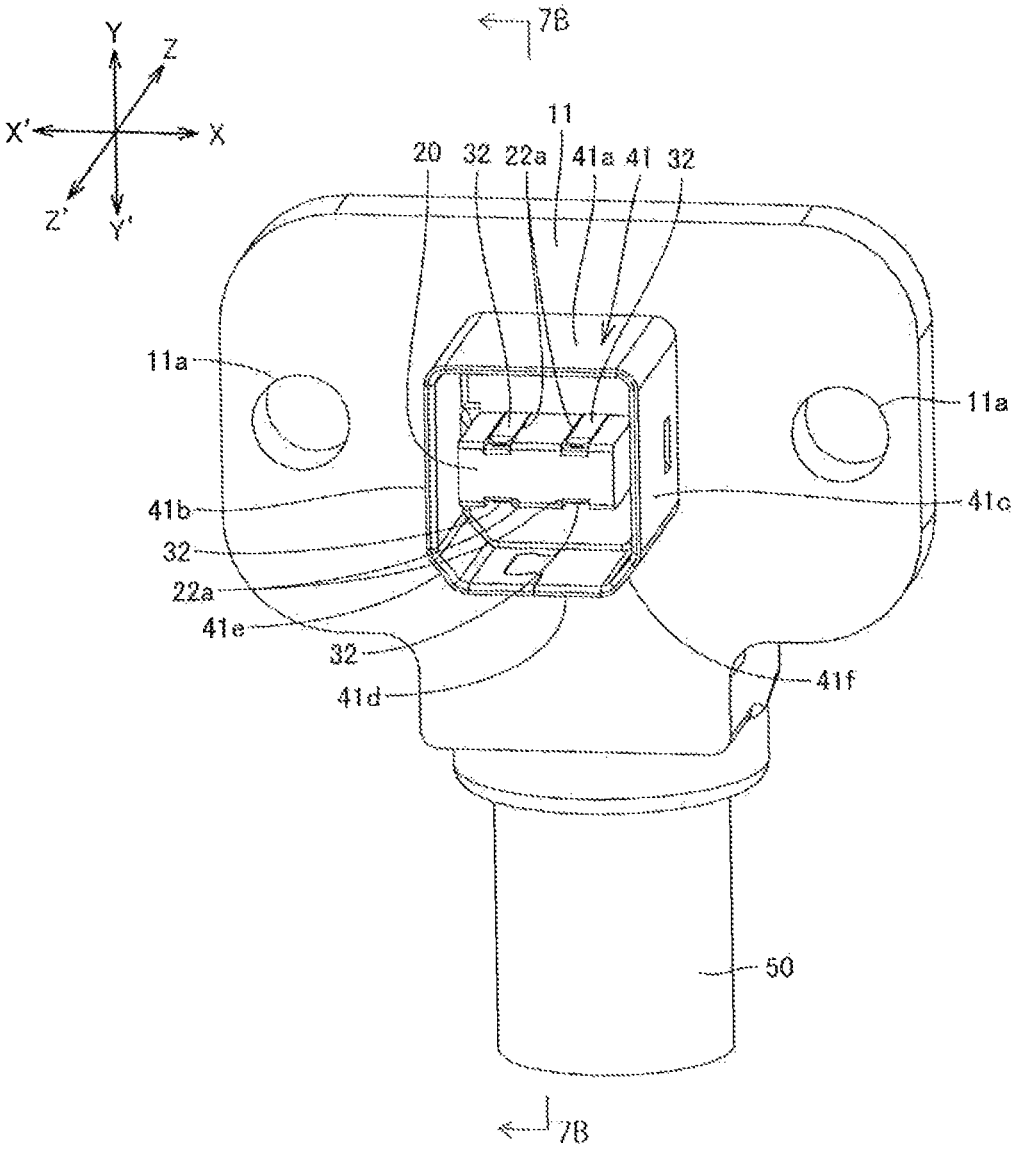
FIG. 7A is a back, top, left side perspective view of the mating connector.
Figure 7B:
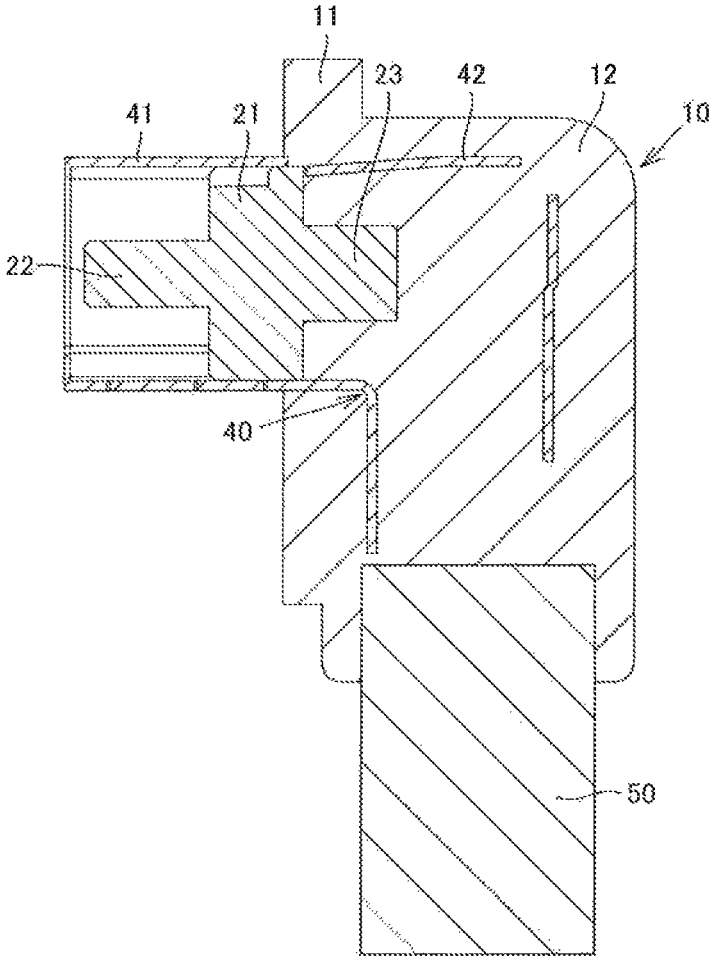
FIG. 7B is a sectional view of the mating connector, taken along 7B-7B in FIG. 7A.

Next, the mating connector F will be described below with reference to FIGS. 7A and 7B. The mating connector P includes a molded part 10, a body 20, a plurality of terminals 30, a shield case 40, and a cable 50.

The body 20 is made of insulating resin. As best illustrated in FIG. 7B, the body 20 includes a base 21, a protrusion 22, and a support 23. The base 21 is a rectangular plate extending in the direction Y-Y'. The protrusion 22 is a plate that is provided the direction-Z'-side end face of the base 21 and extends in the direction Z'. The protrusion 22 has an outer shape conforming to the shape of the connection hole of the connector 100 of the module M, so that protrusion 22 is insertable into the connection hole. As shown in FIG. 7A, the direction-Y-side face of the protrusion 22 has a pair of grooves 22*a* spaced apart from each other in the direction X-X'. The direction-Y'-side face of the protrusion 22 also has a pair of grooves 22*a* spaced apart from each other in the direction X-X'. The support 23 is a plate on the direction-Z-side end face of the base 21, extending in the direction Z.

Figure 2A:
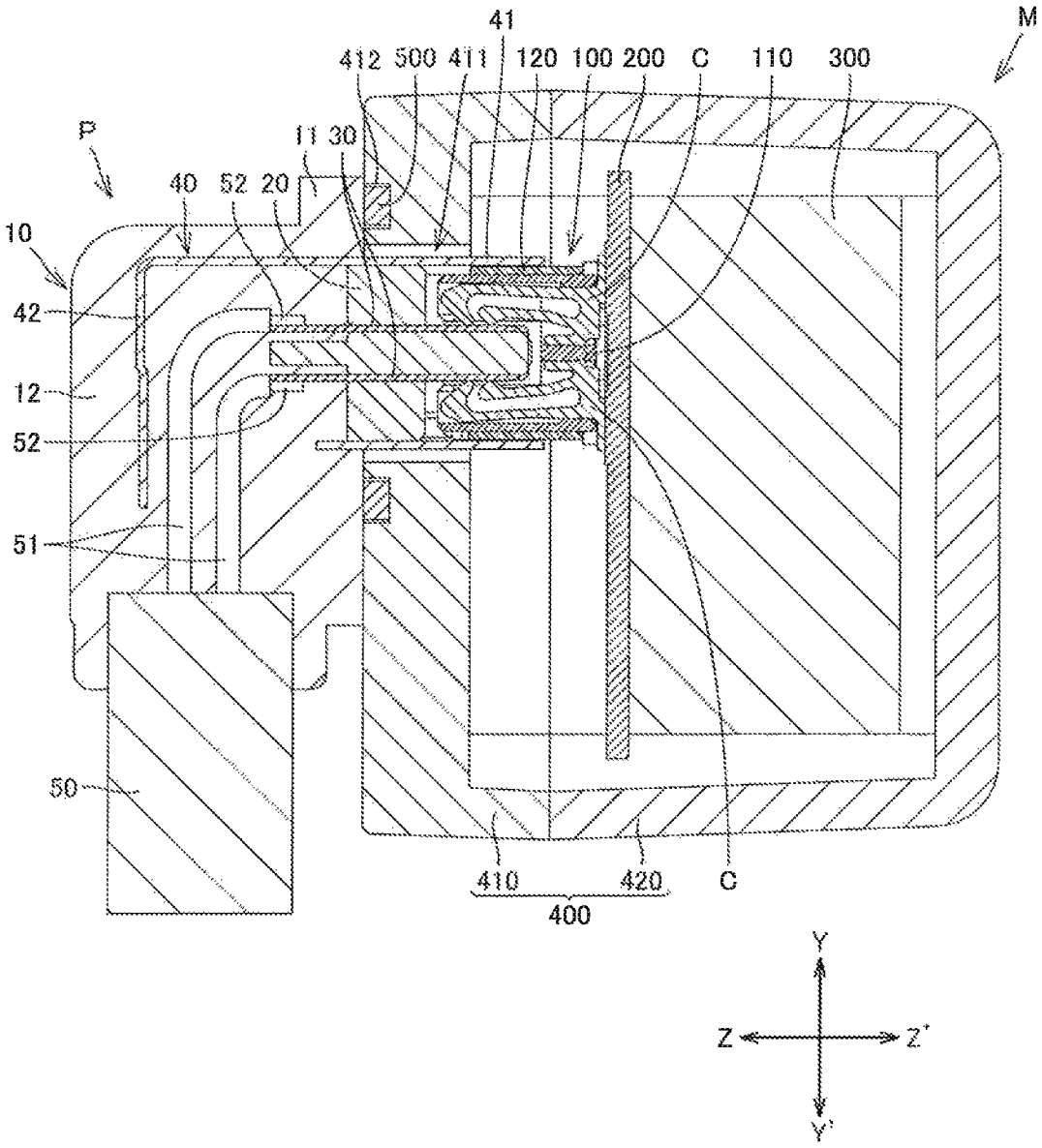
FIG. 2A is a sectional view of the connection structure, taken along 2A-2A in FIG. 1.
Figure 2B:
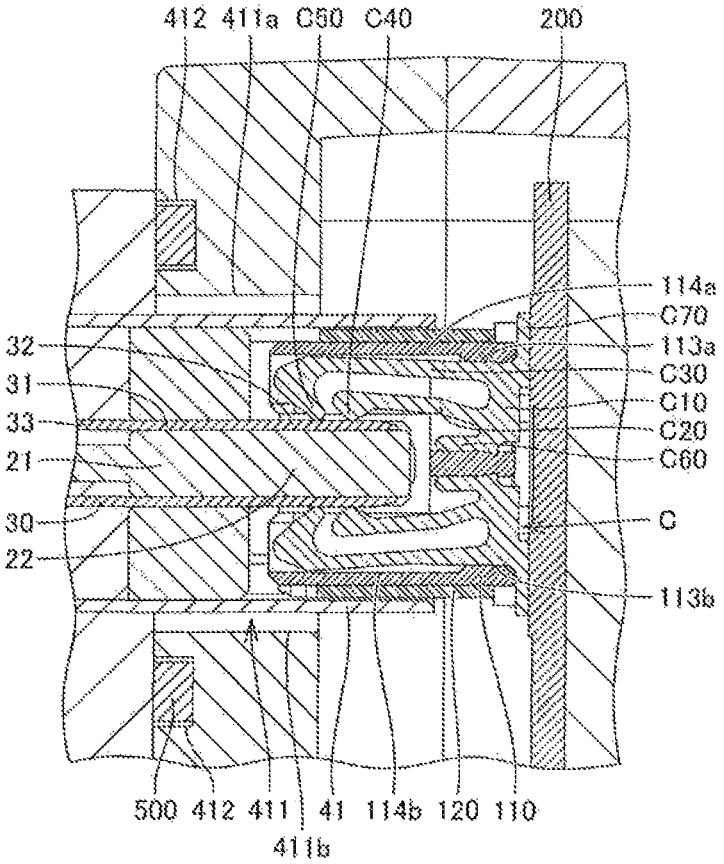
FIG. 2B is a partially enlarged view of the connection structure as illustrated in FIG. 2A.

As best illustrated in FIG. 2B, the terminals 30 are metal plates extending in the direction Z-Z'. The terminals 30 each have an intermediate portion 31, a contact portion 32, and a connecting portion 33. The intermediate portions 31 are held in the base 21 of the body 20. The contact portions 32 extend in the direction-Z' from the direction-Z'-side ends of the intermediate portions 31 to be received in the respective grooves 22*a* of the protrusion 22 of the body 20 (see also FIG. 7A). The connecting portions 33 extend in the direction-Z from direction-Z-side ends of the intermediate portions 31 and are disposed on the support 23 of the body 20.

As best illustrated in FIG. 2A, the cable 50 includes a plurality of signal wires 51 and an outer insulator covering the signal wires 51. Each of the signal wires 51 includes a core wire 52 and an inner insulator covering the core wire 52. A lengthwise end portion of each signal wire 51 protrudes from the outer insulator. A lengthwise end portion of each core wire 52 protrudes from the end portion of the signal wire 51. The protruded portions of the core wires 52 are soldered to the associated connecting portions 33 of the terminals 30.

The shield case 40, as best illustrated in FIG. 2A, is formed of a metal plate. The shield case 40 includes the tube 41 and a cover 42. The tube 41 is a hexagonal tube having an inner shape conforming to the outer shape of the connector 300. The tube 41 fittingly receives the base 21 of the body 20 and accommodates the protrusion 22 and the contact portions 32 of the terminals 30. The tube 41 is adapted to be received in the through-hole 411 of the case 400 of the module M to fit over the connector 100. The tube 41 includes the walls 41*a*, 41*b*, 41*c*, 41*d*, 41*e*, and 41*f*. The wall 41*a* is a wall on the direction Y side of the lube 41. The wall 41*b* is a wall on the direction X' side of the tube 41. The wall 41*c* is a wall on the direction X side of the tube 41. The wall 41*d* is a wall on the direction Y' side of the tube 41. The wall 41*e* is a wall on a direction X' and Y' side of the tube 41. The wall 41*f* is a wall on a direction X and Y' side of the tube 41. The cover 42 is a generally L-shaped plate contiguous with the tube 41 in sectional view. The cover 42 covers the support 23 of the body 20, the connecting portions 33 of the terminals 30, and the above-mentioned end portions of the signal wires 51 of the cable 50.

The molded part 10 is insulating resin that is filled around and inside the cover 42. The molded part 10 includes a tab 31 and a body 12. The body 12 is a rectangular parallelepiped block made of insulating resin, and extends in the direction (direction Y-Y') substantially vertical to the length direction of the tube 41 (direction Z-Z'). Embedded in the body 12 are the support 23 of the body 20, the connecting portions 33 of the terminals 30, the end portions of the signal wires 51 of the cable 50, and the cover 42. This embedding may be given by insert molding, potting, or any other means that renders the mating connector P waterproof. The tab 11 surrounds the body 12. The tab 11 includes a pair of engaging holes 11*a* at positions corresponding to the engaging holes 413 of the case 400 of the module M. As shown in FIG. 8A, the engaging holes 11*a* are larger in diameter than the engaging holes 413.

The fastening mechanism R includes the pair of engaging holes 413 of the case 400 of the module M, the pair of engaging holes 11*a* of the molded part 10 of the mating connector R and a pair of pins R1 (engaging part (see FIG. 1)). The pins R1 are engageable with the engaging holes 11*a* and the engaging holes 413.

The mating connector P as described above may be connected to the module M in the following manner. The tube 41 of the mating connector P can be smoothly inserted into the through-hole 411 of the case 400 of the module M in any of the following manners (1)-(4). (1) If the wall 41*a* of the tube 41 is brought into abutment with the inner wall 411*a* of the through-hole 411 as shown in FIG. 8B, the wall 41*d* of the tube 41 is disposed near the guides 112*d*1 of the body 110 and the guides 122*d*1, 122*d*2 of the shell 120 of the module M. Upon further inserting the tube 41 of the mating connector P into the through-hole 411 of the case 400 of the module M, the wall 41*d* of the tube 41 is brought into contact with and guided on the guides 112*d*1 of the body 110 and the guides 122*d*1, 122*d*2 of the shell 120 of the module M. The connector 100 is thus fitted into the tube 41 and the mating connector P is connected to the connector 100 of the module M, specifically in the following arrangement. The protrusion 22 of the body 20 of the mating connector P is received in the connection hole of the connector 100, and the contact portions 32 of the terminals 30 of the mating connector P are in abutment with the first and second contact portions C40, C50 of the terminals C of the connector 100; the first and second contact portions C40, C50 are pressed by the contact portions 32 (i.e. subjected to load) to elastically deform in the direction away from the contact portions 32 (i.e. in the alignment direction of the first and second arms C20, C30); and the pressed first and second contact portions C40, C50 are in contact with the contact portions 32 with a predetermined contact pressure.

(2) If the wall 41*d* of the tube 41 is brought into abutment with the inner wall 411*b* of the through-hole 411, the wall 41*a* of the tube 41 is disposed near the guides 112*a*1 of the body 110 and the guide 122*a* of the shell 120 of the module M. Upon further inserting the tube 41 of the mating connector P into the through-hole 411 of the case 400 of the module M, the wall 41*a* of the tube 41 is brought into abutment with and guided on the guides 112*a*1 of the body 110 and the guide 122*a* of the shell 120 of the module M. The connector 100 is thus fitted into the tube 41 and the mating connector P is connected to the connector 100 of the module M, specifically in the above-described arrangement.

(3) If the wall 41*c* of the tube 41 is brought into abutment with the inner wall 411*c* of the through-hole 411 as shown in FIG. 8A, the wall 41*b* of the tube 41 is disposed near the guides 112c1, 112f1 of the body 110 and the guides 122c, 122f of the shell 120 of the module M. Upon further inserting the tube 41 of the mating connector P into the through-hole 411 of the case 400 of the module M, the wall 41b of the tube 41 is brought into abutment with and guided on the guides 112c1, 112f1 of the body 110 and the guides 122c, 122f of the shell 120 of the module M. The connector 100 is thus fitted into the tube 41 and the mating connector P is connected to the connector 100 of the module M, specifically in the above-described arrangement.

(4) if the wall 41b of the tube 41 is brought into abutment with the inner wall 411d of the through-hole 411, the wall 41c of the tube 41 is disposed near the guides 112b1, 112e1 of the body 110 and the guides 122b, 122e of the shell 120 of the module M. Upon further inserting the tube 41 of the mating connector P into the through-hole 411 of the case 400 of the module M, the wall 41c of the tube 41 is brought into abutment with and guided on the guides 112b1, 112e1 of the body 110 and the guides 122b, 122e of the shell 120 of the module M. The connector 100 is thus fitted in the tube 41 and the mating connector P is connected to the connector 100 of the module M, specifically in the above-described arrangement.

When the mating connector P is connected to the connector 100 of the module M, the engaging holes 11a of the tab 11 of the mating connector P communicate with the engaging holes 413 of the case 400 of the module M. Then, by engaging the pins III with the engaging holes 11a and the engaging holes 413, the mating connector P is fastened to the case 400 as connected to the module M. The packing 500 is thereby held and compressed between the case 400 of the module M and the molded part 10 of the mating connector P. It is described above that the assembly of the module M includes aligning the center of the imaging device (e.g. CCD, CMOS, or the like) of the electronic component 300 with the optical axis of the lens (not shown) in the second case 420. This alignment may result in a slight positional offset of the connector 100 from the desirable position in the through-hole 411 of the first case 410. When the connector 100 is connected to a mating connector P, the engaging holes 11a of the tab 11 of the mating connector P will be accordingly offset from the desirable positions for communication with the engaging holes 413 of the case 400 of the module M. Specifically, the center axes of the engaging holes 11a are offset from the center axes of the engaging holes 413. However, this offset is unlikely to cause the engaging holes 413 to be blocked by the peripheral area of the engaging holes 11a because the engaging holes 11a have larger diameters than those of the engaging holes 413. Therefore, even if there is a positional offset as described above during the assembly, the engaging holes 413 can engage the engaging holes 11a with the pins R1 without difficulty.

The connector 100 of the module M includes at least the following technical features and advantages. First, the terminals C can be manufactured with a reduced cost because of the following features. The bases C10 of the terminals C each are plates extending in the direction Y-Y', the first and second arms C20, C30 are plates extending from the base C10 in the direction Z-Z', the first and second contact portions C40, C50 are plates extending from the first and second arms C20, C30 in the direction Y or Y', the engaging portions C60 are plates extending in the direction Z, and the tails C70 are plates extending in the direction Y or Y'. These elements of the terminals C are not extended or bent in the direction X-X', the terminals C can therefore be easily manufactured by pressing a metal plate without any bending process. The die for producing the terminals C can be simplified, resulting in reduced manufacturing costs of the terminals C.

Second, the first and second contact portions C40, C50 provide increased contact pressure against the terminals 30 of the mating connector P for the following reason. The first and second arms C20, C30 are plates extending in the direction Z-Z'. They can elastically deform in the direction Y' or Y when the first and second contact portions C40, C50 contact the terminals 30 from the direction Y or Y', respectively.

Third, the terminals C and the terminals 30 of the mating connector P provides improved reliability of connection therebetween for the following reason. Both the first and second contact portions C40, C50 of each terminal C are adapted to contact the associated terminal 30 of the mating connector P. The first and second contact portions C40, C50 are aligned in the direction Z-Z'. Therefore, even if the mating connector P is offset from the module M in the direction Z-Z', it is more likely that at least one of the first and second contact portions C40, C50 is kept in contact with the associated terminal 30 of the mating connector P. In addition, the first and second arms C20, C30 of the terminals C have different lengths and therefore have different natural vibration frequencies. Thus, even when the connection structure is under vibration conditions, the first and second arms C20, C30 vibrate in different manners, increasing the possibility of maintaining the contact between at least one of the first and second contact portions C40, C50 and the terminal 30 of the mating connector P.

Embodiment 2

Figure 9A:
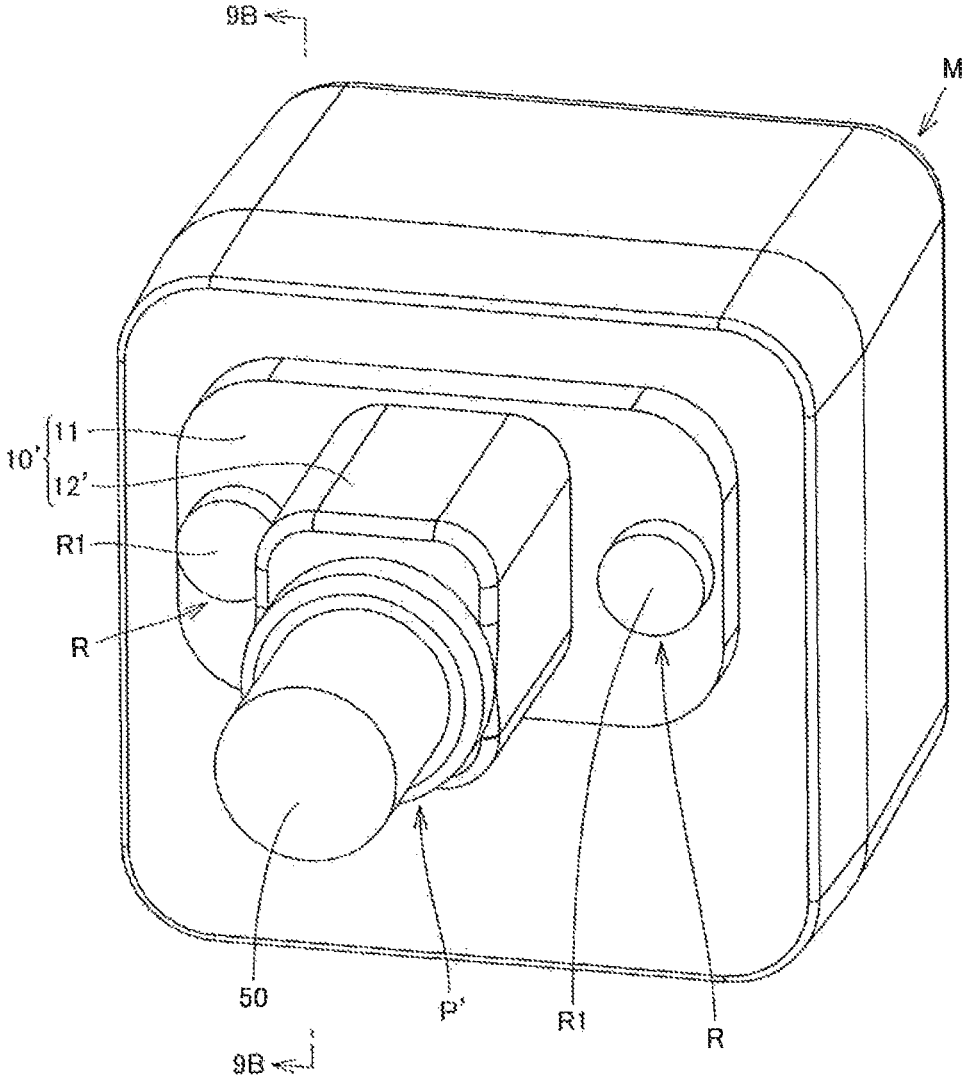
FIG. 9A is a front, top, right side perspective view of a connection structure of a module and a mating connector in accordance with Embodiment 2 of the invention.
Figure 9B:
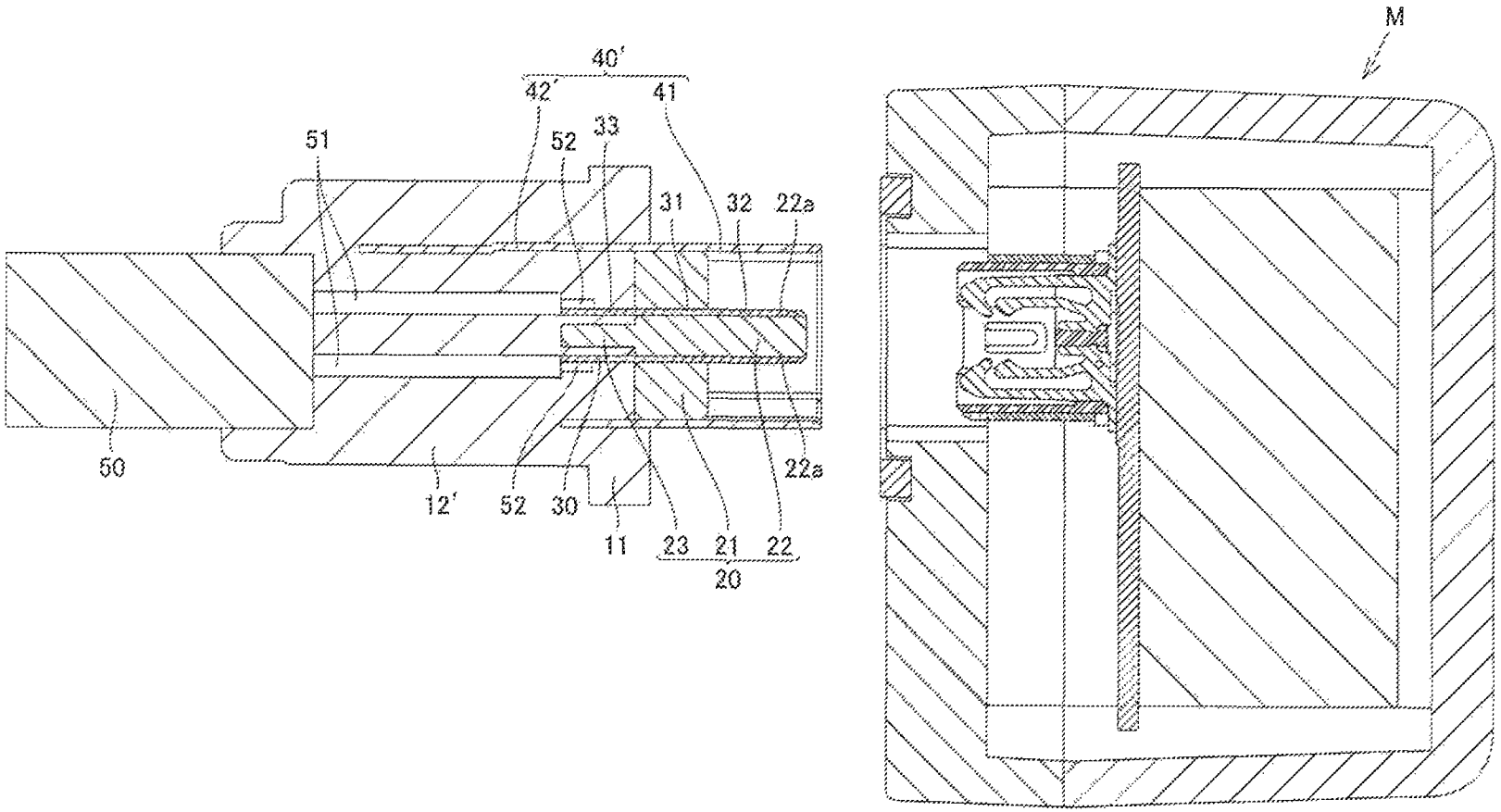
FIG. 9B is a sectional view of the connection structure illustrating the state before the module is connected to the mating connector, taken along 9B-9B in FIG. 9A.

A connection structure of the module and the mating connector in accordance with Embodiment 2 of the invention will be described below with reference to FIGS. 9A to 9B. The connection structure shown in FIGS. 9A and 9B has the same configuration as the connection structure in Embodiment 1, except that a mating connector P' has a different configuration from the mating connector P of Embodiment 1. Only the differences will be described below in detail, and overlapping descriptions will be omitted. A prime symbol (') is added to reference numerals for the mating connector and some of its elements to distinguish them from the mating connector and its elements of Embodiment 1.

The mating connector P' includes the same configuration as the mating connector P except the following differences. The body 12' of the molded part 10' is of different shape from the body 12 of the molded part 10. The cover 42' of the shield case 40' is of different shape from the cover 42 of the shield case 40.

More particularly, the cover 42' is contiguous with the tube 41 and extends in the direction Z-Z'. The cover 42' covers the support 23 of the body 20, the connecting portions 33 of the terminals 30, and the end portions of the signal wires 51 of the cable 50. The body 12' is a rectangular parallelepiped block of insulating resin extending in the length direction of the tube 41 (i.e. the direction Z-Z'). Embedded in the body 12' are the support 23 of the body 20, the connecting portions 33 of the terminals 30, the end portions of the signal wires 51 of the cable 50, and the cover 42'.

The mating connector P' described above can be connected to the connector 100 of the module M in the same manner as the mating connector P of Embodiment 1.

The terminals and connector of the invention are not limited to the above Embodiments but may be modified in any manner within the scope of the claims. Specific modifications will be described below in detail.

The terminal of the invention may be any terminal including a base, first and second arms, and first and second contact portions as described below. The base of the terminal of the invention may be any conductive plate. For example, the base may be a plate extending in the direction Z-Z', a direction including components of the directions Z and Y, a direction including components of the directions Z and Y', a direction including components of the directions Z' and Y, or a direction including components of the direction Z' and Y'.

The first arm of the terminal of the invention may be any plate extending from the base at least in a first direction. For example, the first arm may be a plate extending from the base in a direction including components of the directions Z and Y, a direction including components of the directions Z and Y', a direction including components of the directions Z' and the direction Y, or a direction including components of the directions Z' and Y'.

The second arm of the terminal of the invention may be any plate spaced apart from the first arm in a second direction, extending from the base in the first direction and having a larger dimension in the first direction than that of the first arm. For example, the second arm may be a plate extending from the base in a direction including components of the directions Z and Y, a direction including components of the directions Z and Y', a direction including components of the directions Z' and Y, or a direction including components of the directions Z' and Y'.

The first contact portion of the terminal of the invention may be any a plate extending from the first arm to one side of the second direction. For example, the first contact portion may be a plate extending from the first arm in a direction including components of the directions Z and Y, a direction including components of the directions Z and Y', a direction including components of the directions Z' and Y, or a direction including components of the directions Z' and Y'. The first contact portion may extend from a portion other than the distal portion of the first arm to at least the one side of the second direction.

The second contact portion of the terminal of the invention may be any plate extending from the second arm to the one side of the second direction so as to be located on one side of the first direction of the first contact portion. For example, the second contact portion may be a plate extending from the second arm in a direction including components of the directions Z and Y, a direction including components of the directions Z and Y', a direction including components of the directions Z' and Y, or a direction including components of the directions Z' and Y'. The second contact portion may extend from a portion other than the distal portion of the second arm to at least the one side of the second direction. The distal ends of the first and second contact portions may be at different heights from each other in the second direction. In other words, the distal end of one of the first and second contact portions may be higher in the second direction than the distal portion of the other contact portion.

The tail of the terminal of the invention may be omitted. The base of the terminal may be connected to a circuit board or a cable. The engaging portion of the terminal of the invention may also be omitted. Only the base of the terminal may be held in the holding hole of the body of the connector.

The connector of the invention may be modified in any manner as long as it includes at least one terminal according to any of the above-described aspects and an insulating body for holding the terminal. The body of the invention may include a basal portion, a tongue extending from the basal portion in the first direction, a slit provided in the tongue, and a holding hole provided in the basal portion and in communication with the slit. In this case, the base may be held in the holding hole, the first and second arms may be accommodated in the slit, and the first and second contact portions may include distal portions protruding from the slit. The tongues of the body may be inserted into a connection hole or a recess of the mating connector. Both faces of the tongue in its thickness direction may have a slit or slits. In this case, the basal portion may have the holding holes in communication with the respective slits. The bases of the terminals may be held in the holding holes, the first and second arms of the terminals may be accommodated in the slits, and the distal portions of the first and second contact portions of the terminals may protrude from the slits. The body of the connector may be formed without the holding hole. Instead, the base of the at least one terminal may be embedded in the body of the connector by insert-molding or other means.

The shell of the connector of the invention may be omitted. Alternatively, the shell of the connector of the invention may include at least one wall extending along the second arm of the terminal of any aspect described above. The wall may extend along a plurality of second arms of a plurality of terminals. The connector of the invention is not necessarily built in a module such as the module M as described above but may be built in any electronic equipment.

The mating connector of the invention may have a circuit board (connection object) in place of the terminal. In this case, the circuit board may include a conductive part on a face thereof for contact with the first and second contact portions of the terminal of the above-described connector.

It should be appreciated that the embodiments and modifications thereof are described above by way of examples only. The materials, shapes, dimensions, numbers, arrangements, and other configurations of the constituents of the terminal and the connector of the invention may be modified in any manner if they can perform similar functions. The configurations of the embodiments and the modifications described above may be combined in any possible manner. The first direction of the invention may be any direction in which the first and second arms of the terminal extend. The second direction of the invention may be any direction crossing the first direction. The third direction of the invention may be any direction.

REFERENCE SIGNS LIST

M: module
100: connector
110: body
110*a*: distal portion
112*a*-112*h*: corner
112*a*1-112*h*1: guide
113*a*, 113*b*: holding holes
114*a*, 114*b*: slit
120: shell
120*a*: lip
121*a*-121*h*: corner
122*a*-122*h*: guide
C: terminal
C10: base
C20: first arm
C30: second arm
C40: first contact portion
C50: second contact portion
C60: engaging portion
C70: tail
200: circuit board
300: electronic component
400: case
410: first case
411: through-hole
411*a*-411*d*: inner wall

420: second case
500: packing
P: mating connector
10: molded part
20: body
30: terminal
40: shield case
41: tube
41*a* to 41*f*: wall
50: cable
R: fastening mechanism
413: engaging hole
11*a*: engaging hole
R1: pin

The invention claimed is:

1. A connector comprising:

a plurality of terminals, each terminal including:

a base of a plate-like shape;

a first arm of a plate-like shape, the first arm extending from the base in a first direction;

a second arm of a plate-like shape, the second arm extending from the base in the first direction, being spaced apart from the first arm in a second direction crossing the first direction, and having a larger dimension in the first direction than that of the first arm;

a first contact portion of a plate-like shape, the first contact portion extending from the first arm to one side of the second direction; and a second contact portion of a plate-like shape, the second contact portion extending from the second arm to the one side of the second direction so as to be located on one side of the first direction of the first contact portion;

a body having an insulating property and being configured to hold the terminals, the body including:

a basal portion, a tongue extending from the basal portion in the first direction, a plurality of slits arranged in the tongue in spaced relation to each other along a third direction, the third direction crossing the first and second directions, and a plurality of holding holes arranged in the basal portion in spaced relation to each other along the third direction and in communication with the respective slits; and a shell configured to cover at least an outer periphery of the body, the shell including a wall, wherein the base of each terminal is held in the associated holding hole, the first and second arms of each terminal are accommodated in the associated slit, the first and second contact portions of each terminal include distal portions protruding from the associated slit, and the second arms of the terminals extend along the wall of the shell.

2. The connector according to claim 1, wherein the wall of the shell comprises a first wall and a second wall, the tongue comprises a pair of tongues provided on the basal portion in spaced relation to each other along the second direction, the slit comprises a plurality of first slits and a plurality of second slits, the first slits being provided in one of the tongues in spaced relation to each other along the third direction, and the second slits being provided in the other tongue in spaced relation to each other along the third direction, the holding hole comprises a plurality of first holding holes and a plurality of second holding holes, the first holding holes being provided in the basal portion and in communication with the associated first slits, and the second holding holes being provided in the basal portion and in communication with the associated second slits, and the terminal comprises a plurality of first terminals and a plurality of second terminals, wherein the first terminals each include the base held in the associated first holding hole, the first and second arms accommodated in the associated first slit, and the first and second contact portions, the distal portions of the first and second contact portions protruding from the associated first slit, the second arms of the first terminals extend along the first wall, the second terminals each include the base held in the associated second holding hole, the first and second arms accommodated in the associated second slit, and the first and second contact portions, the distal portions of the first and second contact portions protruding from the associated second slit, and the second arms of the second terminals extend along the second wall.

3. The connector according to claim 1, wherein the second arms of the terminals extend along and substantially in parallel with the wall of the shell so as to match impedances of the terminals.

* * * * *